US007815268B2

(12) United States Patent
Lee et al.

(10) Patent No.: US 7,815,268 B2
(45) Date of Patent: Oct. 19, 2010

(54) APPARATUS FOR TILTING DOOR FOR REFRIGERATOR

(75) Inventors: Chang Lim Lee, Masan (KR); Young Nam Kim, Changwon (KR); Gi-Yong Moon, Pohang (KR)

(73) Assignee: LG Electronics Inc., Seoul (KR)

( * ) Notice: Subject to any disclaimer, the term of this patent is extended or adjusted under 35 U.S.C. 154(b) by 1017 days.

(21) Appl. No.: 11/501,704

(22) Filed: Aug. 10, 2006

(65) Prior Publication Data

US 2007/0035222 A1 Feb. 15, 2007

(30) Foreign Application Priority Data

Aug. 11, 2005 (KR) ..... 10-2005-0073974
Sep. 1, 2005 (KR) ..... 10-2005-0081404
Sep. 1, 2005 (KR) ..... 10-2005-0081413
Oct. 11, 2005 (KR) ..... 10-2005-0095325

(51) Int. Cl.
*F25D 23/02* (2006.01)

(52) U.S. Cl. ..... 312/402; 312/405; 126/194; 16/286

(58) Field of Classification Search ..... 312/402, 312/303, 333, 323, 319.2, 405, 404, 401, 312/330.1; 62/382, 449; 220/558; 126/194, 126/41 D, 340, 191, 192, 197; 292/275; 16/286.89, 286
See application file for complete search history.

(56) References Cited

U.S. PATENT DOCUMENTS 2,116,370 A * 5/1938 Watkins ..... 109/70
2,683,446 A * 7/1954 Groff ..... 126/191
2,721,547 A * 10/1955 Pollock ..... 126/191
2,843,441 A * 7/1958 Jewell ..... 312/301
2,987,363 A * 6/1961 Morse ..... 312/274
3,065,498 A * 11/1962 Johnson ..... 16/359
3,191,217 A * 6/1965 Squire ..... 16/289
3,295,908 A * 1/1967 Dawley et al. ..... 312/303
3,304,932 A * 2/1967 Gilliom ..... 126/194
3,398,735 A * 8/1968 Barber ..... 126/191
3,503,380 A * 3/1970 Vasaturo ..... 126/191
3,842,542 A * 10/1974 White et al. ..... 49/386
3,955,865 A * 5/1976 Wilson ..... 126/191
4,001,973 A * 1/1977 Rice et al. ..... 49/386
4,021,968 A * 5/1977 Kendall ..... 49/386

(Continued)

FOREIGN PATENT DOCUMENTS

KR 10-2004-0094783 11/2004

(Continued)

OTHER PUBLICATIONS

Korean Office Action dated Oct. 26, 2006.

*Primary Examiner*—James O Hansen
(74) *Attorney, Agent, or Firm*—KED & Associates, LLP

(57) ABSTRACT

Disclosed is an apparatus for tilting a door for a refrigerator. The apparatus includes: the door selectively opening and closing a storage chamber; a basket frame provided on a rear surface of the door and having a basket detachably installed on the basket frame; a tilting hinge connecting the door to the basket frame so that the door is tilted by a desired angle; and a tilting prevention pin having one end extending through a side of the tilting hinge and the other end supported by a side of the basket frame, for restricting and allowing the tilting of the door.

5 Claims, 16 Drawing Sheets

U.S. PATENT DOCUMENTS

| | | | | | |
|---|---|---|---|---|---|
| 4,163,344 | A * | 8/1979 | Scherer | 49/386 |
| 4,194,321 | A * | 3/1980 | Hess | 49/389 |
| 4,269,165 | A * | 5/1981 | Wrotny et al. | 126/191 |
| 4,287,873 | A * | 9/1981 | Goins et al. | 126/194 |
| 4,315,495 | A * | 2/1982 | Jellies | 126/194 |
| 4,665,892 | A * | 5/1987 | Spargo et al. | 126/194 |
| 4,843,680 | A * | 7/1989 | Cress et al. | 16/289 |
| 5,291,634 | A * | 3/1994 | Zanetti | 16/333 |
| 5,341,542 | A * | 8/1994 | Hannan et al. | 16/289 |
| 5,822,925 | A * | 10/1998 | McKinney et al. | 49/386 |
| 5,881,710 | A * | 3/1999 | Davis et al. | 126/194 |
| 5,937,481 | A * | 8/1999 | Faringosi | 16/332 |
| 6,035,848 | A * | 3/2000 | Ray et al. | 126/194 |
| 6,397,836 | B1 * | 6/2002 | Pelletier et al. | 126/194 |
| 6,453,510 | B1 * | 9/2002 | Cummins et al. | 16/343 |
| 6,539,581 | B1 * | 4/2003 | Faringosi | 16/327 |
| 6,637,319 | B1 * | 10/2003 | Vanini et al. | 99/467 |
| 6,789,293 | B2 * | 9/2004 | Habegger et al. | 16/343 |
| 6,892,424 | B1 * | 5/2005 | Habegger et al. | 16/289 |
| 6,986,187 | B2 * | 1/2006 | Cummins et al. | 16/286 |
| 2003/0213098 | A1 * | 11/2003 | Cummins et al. | 16/286 |
| 2004/0000028 | A1 * | 1/2004 | Kim | 16/230 |
| 2004/0100168 | A1 * | 5/2004 | Choi | 312/296 |
| 2004/0172787 | A1 * | 9/2004 | Collene et al. | 16/289 |
| 2004/0183415 | A1 * | 9/2004 | Kim | 312/402 |
| 2005/0127804 | A1 * | 6/2005 | Kim et al. | 312/402 |

FOREIGN PATENT DOCUMENTS

| | | |
|---|---|---|
| WO | WO 03/083392 | * 10/2003 |

* cited by examiner

APPARATUS FOR TILTING DOOR FOR REFRIGERATOR

BACKGROUND OF THE INVENTION

1. Field of the Invention

The present invention relates to a refrigerator, and more particularly to an apparatus for tilting a door for a refrigerator, which can selectively restrict or allow the tilting of the door for the refrigerator.

2. Description of the Prior Art

A refrigerator refers to an appliance for freezing or refrigerating foods. Generally, the refrigerator includes a freezing chamber, a refrigerating chamber, and doors for selectively opening and closing the freezing chamber and the refrigerating chamber. The doors for the freezing and refrigerating chambers close and open the freezing and refrigerating chambers in various manners for the purpose of ease of use.

FIG. 15 is a view showing a conventional refrigerator.

As shown in FIG. 15, the refrigerator is provided with a storage chamber in the body 10 thereof. stationary rails 11R are provided to both sidewalls of the body 10 defining the storage chamber. The stationary rails 11R are attached to both sidewalls of the body along the width of the sidewall.

The storage chamber is selectively opened and closed by means of a door 13. The door 13 is provided at an upper portion on a front surface thereof with a door handle 13H that a user grips with his/her hand in order to open and close the door 13.

The door 13 also includes tilt hinges (not shown) provided at lower ends of the back surface thereof. The tilt hinges extend through hinge connection members (not shown) provided to the lower ends of the back surface thereof, respectively. The tilt hinges connect the door 13 to a basket frame 15 described below so that the door 13 has an upper end thereof which rotates around the lower end thereof from the front of the storage chamber so as to tilt to a predetermined angle.

The door 13 is provided with the basket frame 15 on the back surface thereof. The basket frame 15 includes basket installation members 16 to which a basket 19 described below is detachably attached, and door connection members 17 connected to the back surface of the door 13.

The basket installation members 16 are horizontally provided and respectively have a square frame shape with an opened front end. The basket installation members are provided with moving rails 16R which are respectively attached to an outer surface of each basket installation member 16. The moving rails 16R slide along the fixed rails 11R, respectively, when the door 13 opens the storage chamber.

The door connection members 17 are vertically provided and have a square frame shape with an opened lower end. The door connection members 17 have the upper ends thereof fixed to the upper ends of the basket installation members 16, respectively, and the lower end thereof connected to the tilt hinges provided to both lower ends of the door 13, respectively.

The basket 19 is detachably mounted in the basket installation members 16 and can be removed upwardly from the basket installation members 16. A receiving chamber having a predetermined volume is defined in the basket 19 in order to receive foods. Further, as the door 13 operates so as to open and close the storage chamber, the basket 19 can be disposed in and removed from the storage chamber.

Hereinafter, the operation of an apparatus for tilting the door for the refrigerator, which opens and closes the storage space, according to the conventional art will be described.

First, the door handle 13H is grasped and pulled outward from the front of the storage chamber. Thus, the door 13 has the upper end thereof rotating around the lower end thereof, substantially a lower hinge pin, with respect to the basket frame 15 so as to tilt at a desired angle for the front surface of the storage surface.

In the state described above, when the door 13 is continuously pulled in the opposite direction to the storage chamber, the moving rails 15R slide along the fixed rails 11R so as to open the storage chamber. Further, the basket 19 and the basket frame 15 are drawn forward from the storage chamber so as to allow a user to put foods in the basket 19 or to take foods out of the basket 19.

However, the apparatus for tilting the door for the refrigerator according to the conventional art has problems as follows:

As described above, the door 13 can be installed so as to be able to be tilted by means of the tilt hinge. Therefore, in order to minimize outer force applied to the tilt hinge in the process of tilting the door 13, a user supports the door 13 with desired force, while tilting the door.

In addition, the door 13 moves forward from the storage chamber and opens the storage chamber in the state of tilting at a predetermined angle. Specifically, the door 13 is tilted regardless of the user's intention when the storage chamber is opened. Thus, where the door 13 need not be tilted, for example, in the case of putting a relatively large-sized food in the basket 19, there is a disadvantage in that the opening of the storage chamber gives unnecessary troubles to a user.

SUMMARY OF THE INVENTION

Accordingly, the present invention has been made to solve the above-mentioned problems occurring in the prior art, and it is an object of the present invention to provide an apparatus for tilting a door for a refrigerator, which can minimize damage on the door due to exterior force in the operation of tilting the door.

It is another object of the present invention to provide an apparatus for tilting a door for a refrigerator, which can selectively restrict and allow the tilting of the door.

In order to accomplish the object of the present invention, according to the first embodiment of the present invention, there is provided an apparatus for tilting a door by a desired angle for a refrigerator in which the door can open and close a storage chamber, which includes:

a pair of receptacles provided to both sides of a basket frame and having rollers rotatably installed on the receptacles, respectively, the basket frame being disposed on a rear surface of the door and having a basket detachably installed on the basket frame;

a pair of door hinges having one end rotatably connected to the rear surface of the door and the other end fixed to a side of the receptacle; and a tilting hinge having one end rotatably connected to the rear surface of the door, and the other end formed with a roller reception portion in which the roller is received according to the tilting of the door, wherein the tilting hinge is moved by the roller along a predetermined trajectory so that the roller reception portion receives the roller, when the door rotates around the door hinge and is tilted.

The roller is a ball bearing including an inner race restrictedly mounted on a roller pin which is horizontally provided to the receptacle, and an outer race rotating with respect to the inner race depending on the movement of the tilting hinge.

The roller is a sliding bearing which is rotatably mounted on a roller pin which is horizontally provided to the receptacle, and in which lubricant is supplied between the roller and the roller pin.

In order to accomplish the object of the present invention, according to the second embodiment of the present invention, there is provided an apparatus for tilting a door by a desired angle for a refrigerator in which the door can open and close a storage chamber, which includes:

a receptacle provided to both sides of a basket frame and having rollers rotatably installed to the receptacle, the basket frame being disposed on a rear surface of the door and having a basket detachably installed on the basket frame;

a door hinge having one end rotatably connected to the rear surface of the door and the other end fixed to a side of the receptacle; and a tilting hinge having one end rotatably connected to the rear surface of the door, and the other end formed with a stopper reception portion in which the stopper is received according to the tilting of the door, wherein the tilting hinge is moved by the roller along a predetermined trajectory so that the roller reception portion receives the stopper, when the door rotates around the door hinge and is tilted.

The tilting hinge further includes a roller reception portion receiving the roller when the door is tilted, and the stopper is received in the stopper reception portion according to the tilting of the door before the roller is received in the roller reception portion.

The door hinge has one end rotatably connected by means of a first hinge pin to a side of a hinge supporter fixed to the rear surface of the door, and the tilting hinge connected to the other side of the hinge supporter corresponding to an upper portion of the door hinge connected to the hinge supporter by the first hinge pin so as to rotate around a second hinge pin.

The tilting hinge has one end opposed to the roller reception portion and rotatably connected to a lower end of a support member which is movably mounted on the hinge supporter, and is subjected to elasticity from a spring mounted on the support member so as to rotate around an axis of the second hinge in a direction that an upper surface of the tilting hinge comes into close contact with an outer peripheral surface of the roller.

In order to accomplish the object of the present invention, according to the third embodiment of the present invention, there is provided an apparatus for tilting a door by a desired angle for a refrigerator in which the door can open and close a storage chamber and has a basket frame, to which a basket is detachably installed, provided to a rear surface of the door, which includes:

a pair of hinge supporters fixed to the rear surface of the door;

a pair of receptacles fixed to both sides of a basket frame near the rear surface of the door, and having rollers rotatably installed to the receptacles, respectively;

a pair of door hinges having one end rotatably connected to the hinge supporter and the other end fixed to a side of the receptacle;

a tilting hinge connected to a side of the hinge supporter so as to rotate around the side of the hinge supporter and having one end formed with a roller reception portion in which the roller is received;

a pair of support members mounted on the hinge supporter so as to move upward and downward, and having a lower end rotatably connected to one end of the tilting hinge; and a pair of elastic members provided on the support member and providing elasticity to the tilting hinge in a direction that the tilting hinge rotates around a side of the tilting hinge so that the upper surface of the tilting hinge comes into close contact with the outer peripheral surface of the roller.

The receptacle and the tilting hinge further include a stopper reception portion to receive a stopper when the door is tilted, and the stopper is received in the stopper reception portion before the roller is received in the roller reception portion due to the tilting of the door.

In order to accomplish the object of the present invention, according to the fourth embodiment of the present invention, there is provided an apparatus for tilting a door for a refrigerator, which includes:

a door having an upper end tilted around a lower end by a desired angle, for opening and closing a storage chamber;

a basket frame provided on a rear surface of the door, and having a basket detachably attached to the basket frame; and a tilting prevention member having one end simultaneously extending through the door and the basket frame, and the other end extending through only the basket frame, for restricting and allowing the tilting of the door.

Both ends of the tilting prevention member are inserted into a locking hole formed at a side of the basket frame and a first insertion hole formed at a side of a door bracket provided on the rear surface of the door, respectively, in the state of restricting the tilting of the door, while both ends of the tilting prevention member are inserted into the first and second insertion holes formed at a side of the door bracket, respectively, in the state of allowing the tilting of the door.

The tilting prevention member includes: a grip portion having a desired length; and first and second insertion portions extending normally to the grip portion in the same direction so as to be inserted into the locking hole and the first insertion hole, or the first and second insertion holes, respectively.

The tilting prevention member includes: a grip portion having a desired length; a first insertion portion extending normally to one end of the grip portion by a predetermined distance and inserted into the first insertion hole; a second insertion portion extending from the other end of the grip portion in the same direction as the first insertion portion and having a shorter length than the first insertion portion, so as to be inserted into the second insertion hole; and a removal prevention ring provided to one end of the first insertion portion for preventing the first insertion portion from being completely removed from the first insertion hole.

In order to accomplish the object of the present invention, according to the fifth embodiment of the present invention, there is provided an apparatus for tilting a door for a refrigerator, comprising:

the door selectively opening and closing a storage chamber;

a basket frame provided on a rear surface of the door and having a basket detachably installed on the basket frame;

a tilting hinge connecting the door to the basket frame so that the door is tilted by a desired angle; and a tilting prevention pin having one end extending through a side of the tilting hinge and the other end supported by a side of the basket frame, for restricting and allowing the tilting of the door.

The tilting prevention pin has one end inserted into a locking hole formed in a side of the tilting hinge, and the other end supported by a support member provided to a side of the basket frame.

One end of the tilting prevention pin extending through the locking hole is inserted into an insertion hole formed at a side of the basket frame to correspond to the locking hole in the state in which the door shields the storage chamber.

The basket frame has an insertion hole formed at a side of the basket frame, in which one end of the tilting prevention pin is inserted and held in the state of allowing the tilting of the door.

The apparatus further includes a support member disposed on a side of the basket frame for supporting the other end of the tilting prevention pin, in the state of allowing the tilting of the door.

The tilting prevention pin includes a grip portion formed in a ring shape with a desired diameter, a first end extending from a side of the grip portion in a normal direction to a plane surface formed by the grip portion and inserted into the locking hole and/or the insertion hole, and a second end extending from the other side of the grip portion in a tangent direction of the grip portion and supported by the support member, which has a desired elasticity so that one of the first and second ends is elastically deformed with respect to the residual one.

The apparatus further includes a buffer member provided to a contact portion between the rear surface of the door and one end of the tilting hinge so as to absorb impact occurring between the door and tilting hinge, in the state in which the door is tilted at a desired angle.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, an apparatus for tilting a drawer door for a refrigerator according to the first embodiment of the present invention will be described in detail with reference to the accompanying drawings.

Figure 1:
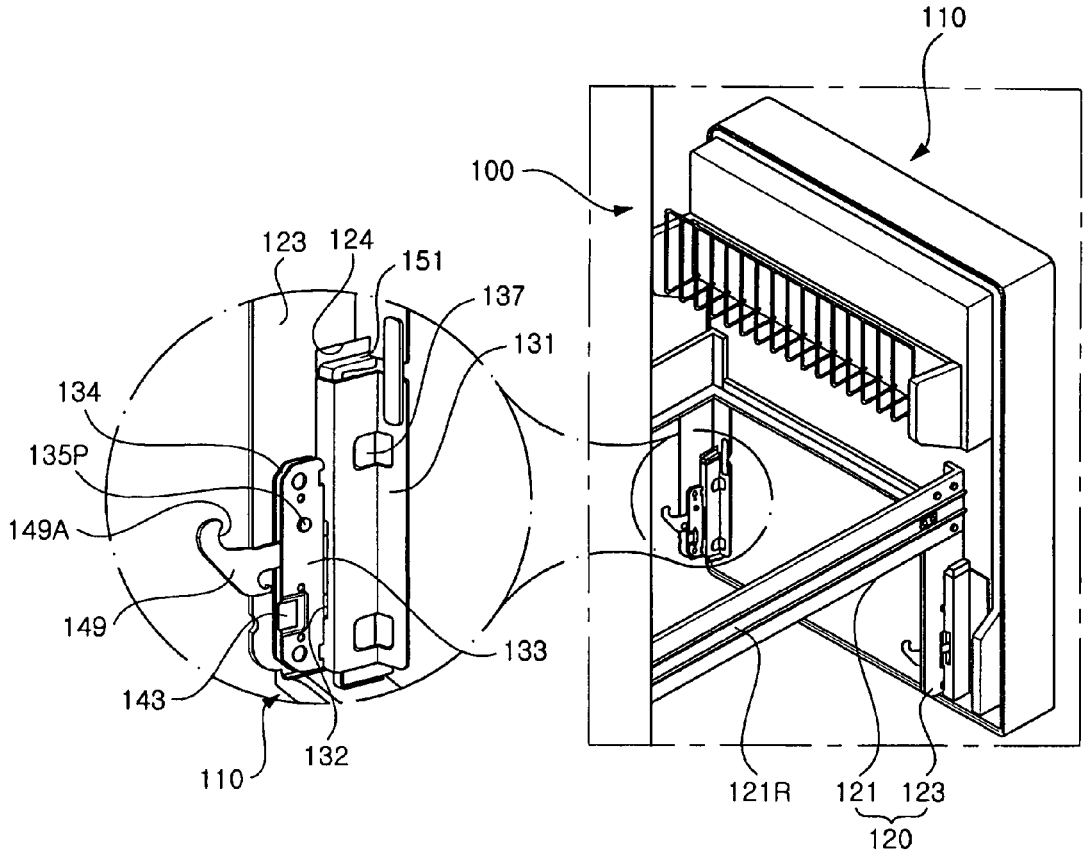
FIG. 1 is a perspective view showing a side of an apparatus for tilting a door for a refrigerator according to the first embodiment of the present invention.
Figure 2:
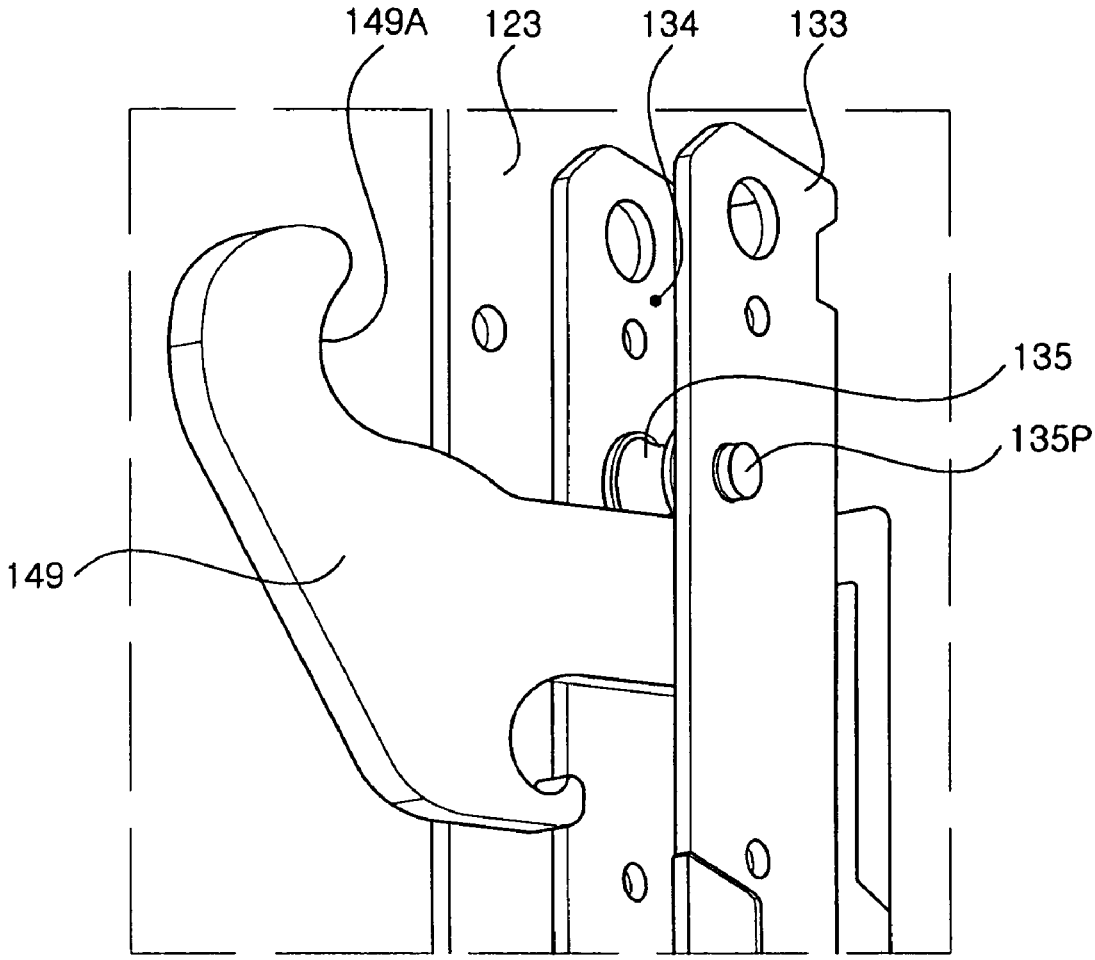
FIG. 2 is a perspective view showing an essential part of the apparatus for titling the door for the refrigerator according to the first embodiment of the present invention.
Figure 3:
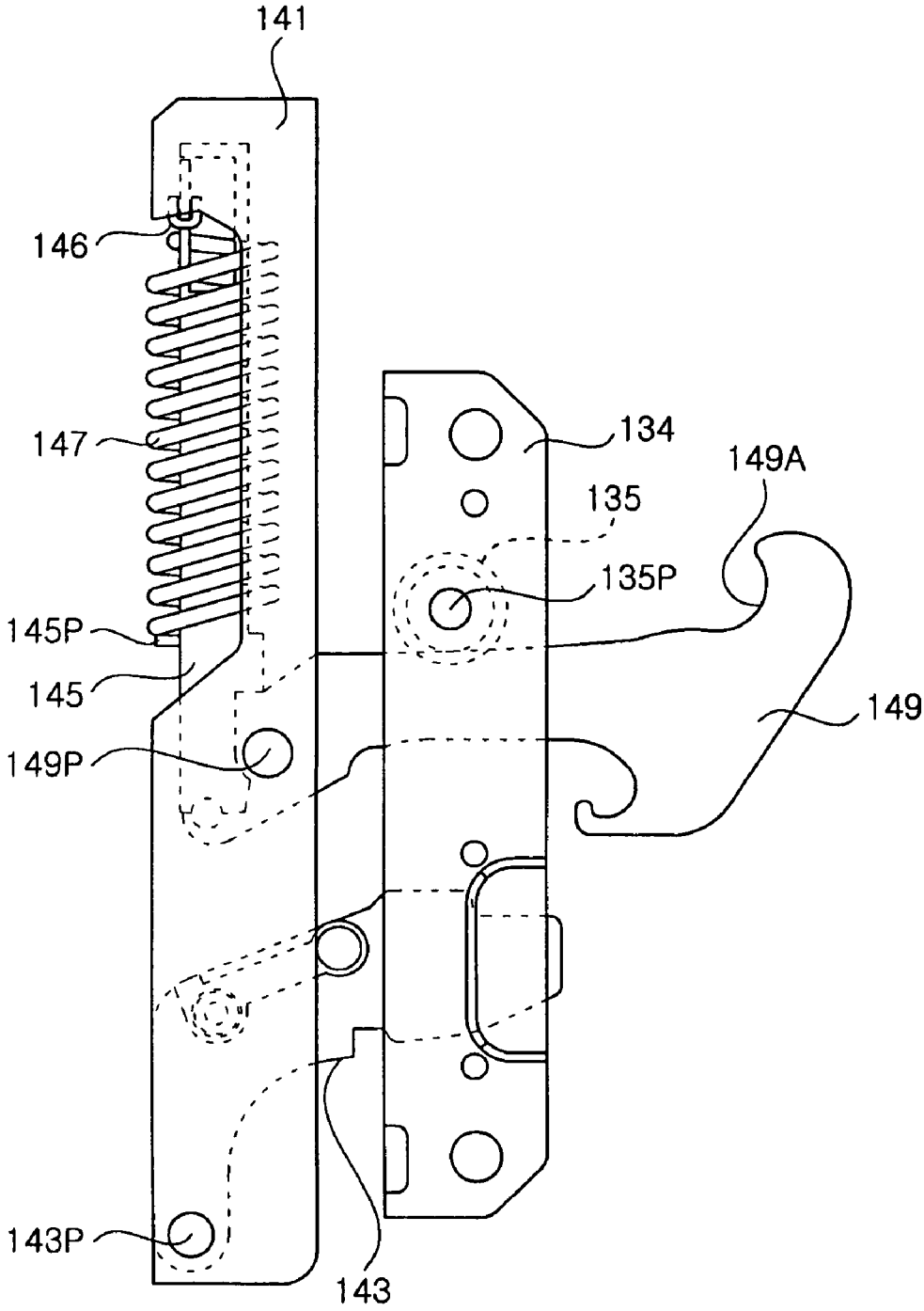
FIG. 3 is a side view showing a hinge assembly of the apparatus for tilting the door for the refrigerator according to the first embodiment of the present invention.
Figure 4:
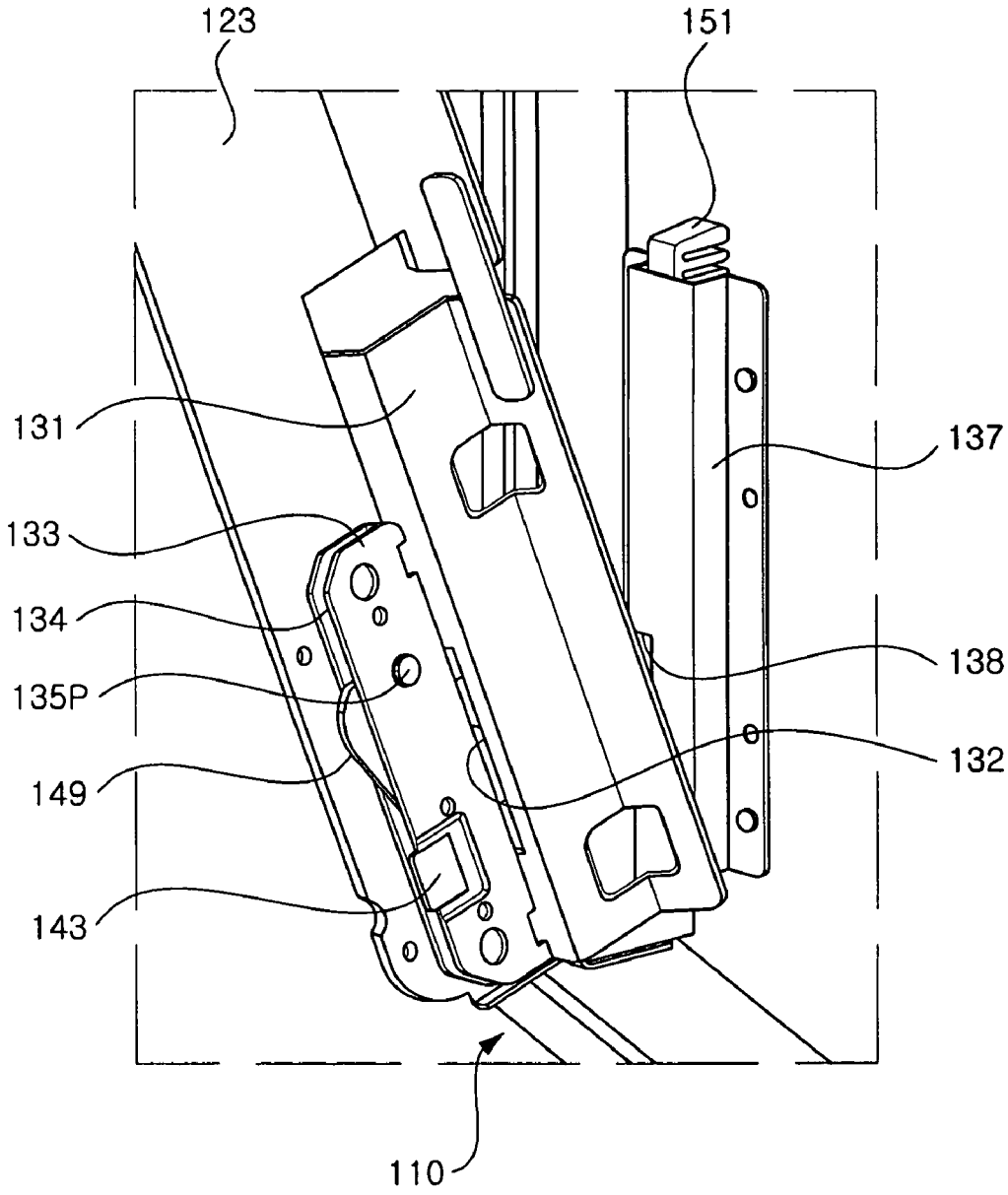
FIG. 4 is a perspective view showing the tilted door according to the first embodiment of the present invention.

FIG. 1 is a perspective view showing a side of an apparatus for tilting a door for a refrigerator according to the first embodiment of the present invention. FIG. 2 is a perspective view showing an essential part of the apparatus for titling the door for the refrigerator according to the first embodiment of the present invention. FIG. 3 is a side view showing a hinge assembly of the apparatus for tilting the door for the refrigerator according to the first embodiment of the present invention. FIG. 4 is a perspective view showing the tilted door according to the first embodiment of the present invention.

As shown in FIGS. 1 to 4, the refrigerator is provided with a storage chamber (not shown) in a body 100 thereof. The storage chamber is selectively opened and closed by means of a door 110. The door 110 makes the storage chamber slide so as to be open and closed, like a drawer.

Further, as the door 110 opens the storage chamber, the basket (not shown) received in the storage chamber is simultaneously drawn out of the storage chamber. For the purpose of drawing the basket, basket frames 120 are provided in order to install the basket (not shown) on the rear surface of the door 110. The basket frames 120 respectively include a basket installation member 121 and a door connection member 123.

The basket installation member 121 has a square frame shape, which is horizontally provided. The basket is detachably mounted in the basket installation member 121. A movable rail 121R is fixed to the exterior surface of the basket installation member 121 and slides along a fixed rail (not shown) attached to the exterior surface of a sidewall defining the storage chamber.

The door connection member 123 has a square frame shape, which is vertically provided. The door connection member 123 has the upper end thereof fixed to the leading end of the basket installation member 121, and the lower end thereof connected to the rear surface of the door 110 by means of a tilt hinge assembly.

Further, a dissection 124 is provided to the lower end of the door connection member 123. The dissection 124 is formed by cutting out a portion of the lower end of the door connection member 123 adjacent to the rear surface of the door 110 so as to correspond to the side end of a door bracket 137 described below, when the door 110 closes the storage chamber, in other words, the state in which the door 110 is not tilted. This is to prevent the interference between the door 110 and the door bracket 137 in the state in which the door 110 is not tilted.

A tilting bracket 131 is fixed to the dissection 124. The tilting bracket 131 has a longitudinally elongated shape and has a C-shaped cross section, which is adjacent to a door bracket 137. The tilting bracket 131 is provided with the first guide slot 132 which is elongated longitudinally.

Further, a receptacle 133 is fixed to the door connection member 123. At this time, the receptacle 133 extends longitudinally, and preferably has a front end corresponding to the rear end of the dissection 124. The receptacle 133 has the second guide slot 134 formed therein. For example, the receptacle 133 is formed by connecting two plates to each other with a predetermined distance, so that the second guide slot 134 can be formed in the receptacle 133. The second guide slot 134 corresponds to the first guide slot 132.

As shown in FIG. 2 in detail, the receptacle 134 is provided with a roller 135. The roller 135 is rotatably assembled with a roller pin 135P extending through the second guide slot 134. The roller 135 allows a tilting hinge 149 described below to smoothly move while the door 110 is tilted at a predetermined angle. Further, when the door 110 is tilted at the predetermined angle, the roller 135 is received in a roller seat 149A so as to prevent the door 110 from being tilted beyond the predetermined angle. To this end, the roller 135 substantially moves along a trajectory formed by an upper surface of the tilting hinge 149 which moves during the tilting of the door 110. Further, the roller 135 is preferably made of steel material so as to sufficiently endure exterior force applied thereto due to the repeated tilting of the door 110.

The roller 135 may have various configurations. For example, a ball bearing, which includes an inner race, an outer race, and a plurality of balls interposed between the inner and outer races, may be used as the roller 135. In this configuration, the inner race may be fixedly mounted on, or rotatably assembled with the roller pin 135P.

Further, the roller 135 has a configuration of a sliding bearing. At this time, lubricant is supplied between the roller 135 and the roller pin 135P, so as to prevent wear and tear of the inner surfaces of the roller 135 and the roller pin 135P and simultaneously minimizing noise while the roller 135 rotates with respect to the roller pin 135P.

Referring to FIG. 4, the door 110 is provided with the door bracket 137 at the lower end on the rear surface thereof. The door bracket 137 is longitudinally elongated on the rear surface of the door 110 and generally has a C-shaped cross section. The door bracket 137 is formed with a through slot 138 corresponding to the first and second guide slots 132 and 134. The through slot 138 is longitudinally elongated on a surface of the door bracket 137 parallel to the rear surface of the door 110.

Meanwhile, as shown in FIG. 3, the tilting hinge assembly is interposed between the rear surface of the door 110 and the inner surface of the door bracket 137. The tilting hinge assembly is used for connecting the door 110 to the basket frame 120, substantially the door connection member 123, so that the door 110 can be tilted with respect to the basket frame 120 at a predetermined angle. Hereinafter, the configuration of the tilting hinge assembly will be described in more detail.

A hinge supporter 141 extends longitudinally between the rear surface of the door 110 and the inner surface of the door bracket 137. The hinge supporter 141 interlocks with the door 100 and rotates as the door 110 is tilted. A door hinge 143, a support bar 145, and the tilting hinge 149 are assembled with the hinge support 141 in order to tilt the door 110 to the predetermined angle.

The door hinge 143 generally has a reversed L shape. The door hinge 143 substantially plays the role of holding the door 110 to the door connection member 123 so as to allow the door 110 to rotate. The door hinge 143 has one end connected to the lower end of the hinge supporter 141 so as to rotate around the first hinge pin 143P. Further, the door hinge 143 has another end sequentially extending through the through slot 138 and the first and second guide slots 132 and 134 and is supported by the receptacle 133.

The support bar 145 is longitudinally elongated along the upper portion of the hinge supporter 141 corresponding to the upper portion of the first hinge pin 143P. The support bar 145 is connected to a side of the hinge supporter 141 so as to move upward and downward with the tilting of the door 100. For example, the upper end of the support bar 141 is inserted into a guide hole (not shown), which is formed in a fixing clip 146 fixed to a side of the hinge supporter 141, so as to move upward and downward. Thus, the support bar 145 can move upward and downward. Further, the support bar 145 has a lower end rotatably connected to an end of the tilting hinge 149.

In addition, the support bar 145 is provided with a spring 147 thereon. The spring 147 provides elasticity to the tilting hinge 149 in a direction that the tilting hinge moves while the tilted door 110 closes the storage chamber. Accordingly, the spring 147 substantially performs a damping function while the door 110 is tilted. Further, the spring 147 allows the door 110 to be easily closed during the closing of the tilted door 110.

For the purpose of that, the spring 147 has both ends supported by the fixing clip 146 and a supporting pin 145P formed on a peripheral surface of the lower portion of the support bar 145, respectively. The spring 147 is compressed and downwardly provides elasticity to the support bar 145 in the state in which the door 110 is not tilted, so as to provide the elasticity to the tilting hinge 149 in a direction that the tilting hinge 149 moves while the door 110 closes the storage chamber.

The tilting hinge 149 enables the door 110 to rotate around the door hinge 143 and tilt by the predetermined angle. The outer peripheral surface of the roller 135 comes in close contact with the upper surface of the tilting hinge 149. The tilting hinge 149 is made from a plate having the upper surface with a desired curvature in order to prevent the outer peripheral surface of the roller 135 from being spaced apart from the upper surface of the tilting hinge 149 due to the tilting of the door 110.

As described above, the tilting hinge 149 extends through the through slot 138 and the first and second guide slots 132 and 134 after the one end of the tilting hinge 149 is rotatably connected to the lower end of the support bar 145. A front portion of the tilting hinge 149, near the one end of the tilting hinge 149 rotatably connected to the lower end of the support bar 145, is connected to the center portion of the hinge support 141 by the second hinge pin 149P so as to rotate around the second hinge pin 149P. Thus, as the door 100 is tilted, the tilting hinge 149 is guided by means of the roller 135 so as to move forward and backward along a predetermined trajectory.

The tilting hinge 149, which extends through the through slot 138 and the first and second guide slots 132 and 134, is formed at another end thereof with the roller reception seat 149A. The roller reception seat 149A receives the roller 135 so as to allow the door 110 to maintain its tilted state at the predetermined angle in the state that the door 110 is tilted by the predetermined angle. The roller reception seat 149A is formed on an upper surface of another end of the tilting hinge 149 so as to have a groove with the curvature corresponding to the peripheral surface of the roller 135.

As shown in FIG. 1, the door bracket 137 is provided at the upper end thereof with an elastic member 151. The elastic member 151 comes in selectively close contact with a side of the door connection member 123 corresponding to the dissection 124, and controls the tilting velocity of the door 110. Since the elastic member 151 has no relation with the gist of the present embodiment, the description of the elastic member 151 will be omitted.

Hereinafter, the apparatus for tilting a door for a refrigerator according to the first embodiment of the present invention, which has the above-mentioned configuration, will be described.

As shown in FIGS. 1 to 3, first, in the state that the door 110 is not tilted so as to close the storage chamber, the door connection member 123 comes in close contact with the rear surface of the door 110. The door bracket 137 and the tilting bracket 131 are located so that the outer surface of the door bracket 137 is near the inner surface of the tilting bracket 131.

The tilting hinge 149 extends through the through slot 138 and the first and second guide slot 132 and 134 toward the rear portion of the door 110. At this time, the upper surface of the tilting hinge 149 comes in close contact with the outer peripheral surface of the roller 135 by the elasticity of the spring 147. Specifically, as the support bar 145 is moved downward by the elasticity of the spring 147, the external force is substantially applied to the tilting hinge 149 so that the tilting hinge 149 rotates around the second hinge pin 149P such that one end of the tilting hinge 149 moves downward and another end thereof moves upward. Therefore, the tilting hinge 149 is maintained such that the upper surface of the tilting hinge 149 is in close contact with the outer peripheral surface of the roller 135, so that the door 110 can securely close the storage chamber.

On the other hand, in the state that the door 110 closes the storage chamber, in order to put or draw foods in/from the storage chamber, the door 110 is pulled forward from the storage chamber so as to open the storage chamber. Under different circumstances, the door 110 may be tilted by the predetermined angle so as to open a portion of the storage chamber, thereby making it possible to put and draw foods in/from the storage chamber.

As described above, in order to tilt the door by the predetermined angle, the upper end of the door 110 is pulled downward. Accordingly, the door 110 can rotate around the door hinge 143, substantially the first hinge pin 143P. Further, the tilting hinge 149 is guided by the roller 135 and moves forward along a desired trajectory.

Meanwhile, the tilting hinge 149 is rotatably connected by means of the second hinge pin 149P to the hinge supporter 141. When the door 110 is tilted, one end of the tilting hinge 149 rotates clockwise around the second hinge pin 149P, and another end of the tilting hinge 149 rotates counterclockwise around the second hinge pin 149P. Therefore, since the spring 147 applies elasticity to the tilting hinge 149 such that one end of the tilting hinge 149 moves downward, and the other end thereof moves upward, the roller 135 cannot be spaced apart from the upper surface of the tilting hinge 149.

When the door 110 is continuously pulled downward, the tilting hinge 149 is guided by the roller 135 and moves forward along the desired trajectory. Further, when the door 110 is tilted by the predetermined angle, the roller 135 is received in the roller seat 149A. As a result, the tilting hinge 149 cannot move forward. Thus, the door 110 also cannot be tilted anymore. That is, the door 110 maintains its tilted state at the predetermined angle.

Accordingly, the upper portion of the storage chamber opens, so that foods can be drawn out of or put in the storage chamber. When the drawing and putting of foods out of/in the storage chamber are completed, the upper end of the door 110 is pushed upward to be inclined, so as to close the storage chamber.

As described above, the process of pushing the upper end of the door 110 upward so as to close the storage chamber is carried out in an opposite manner to the process of tilting the door 110. When the upper end of the door 110 is pushed upward to be inclined, the door 110 rotates around the door hinge 143. Further, the tilting hinge 149 is guided by the roller 135 and moves backward along the desired trajectory. Thus, the roller 135 is released from the roller reception seat 149A, and the storage chamber is closed by the door 110.

Hereinafter, an apparatus for tilting a drawer type door for a refrigerator according to the second embodiment of the present invention will be described in detail with reference to the drawings.

Figure 5:
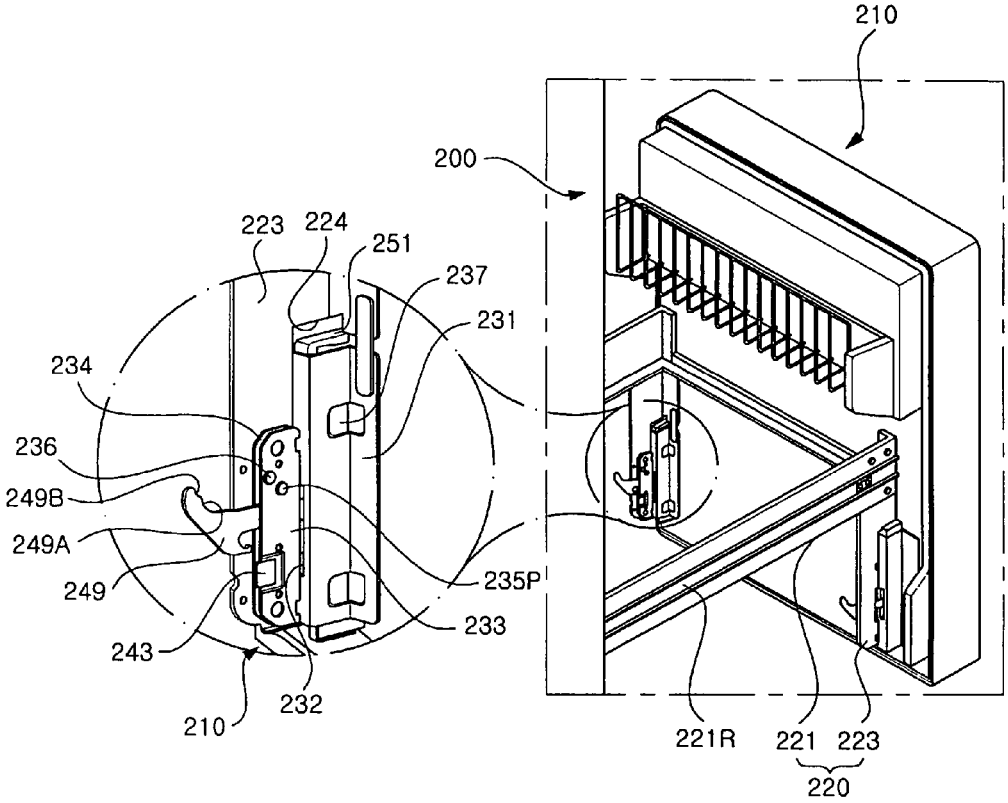
FIG. 5 is a perspective view showing a side of an apparatus for tilting a door for a refrigerator according to the second embodiment of the present invention.
Figure 6:
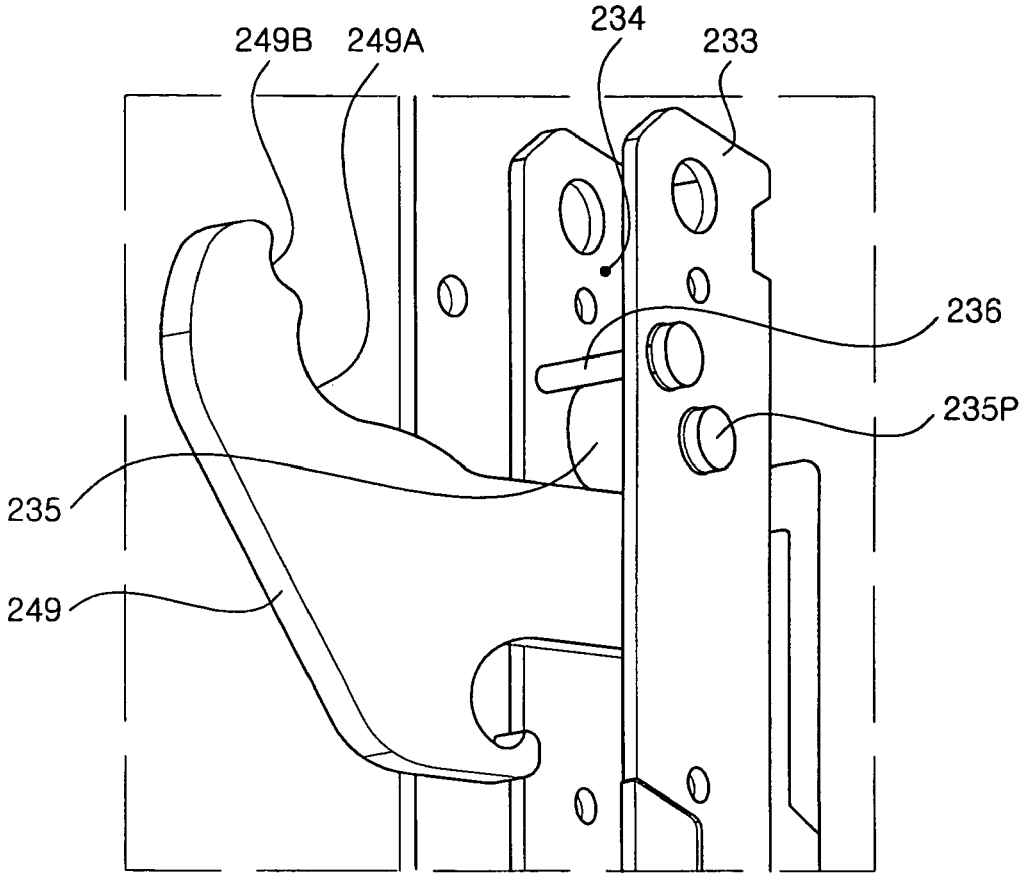
FIG. 6 is a perspective view showing an essential part of the apparatus for titling the door for the refrigerator according to the second embodiment of the present invention.
Figure 7:
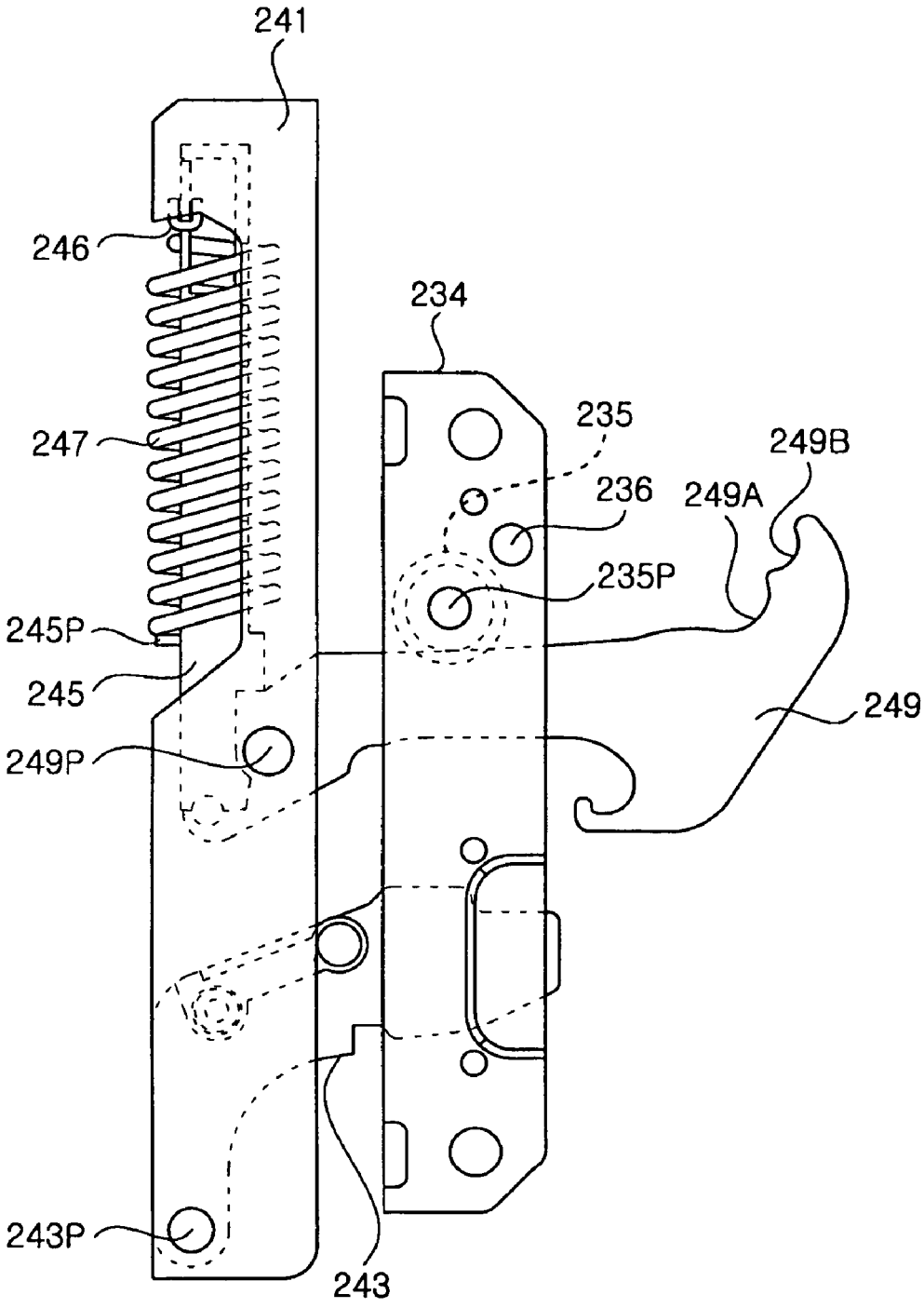
FIG. 7 is a side view showing a hinge assembly of the apparatus for tilting the door for the refrigerator according to the second embodiment of the present invention.
Figure 8:
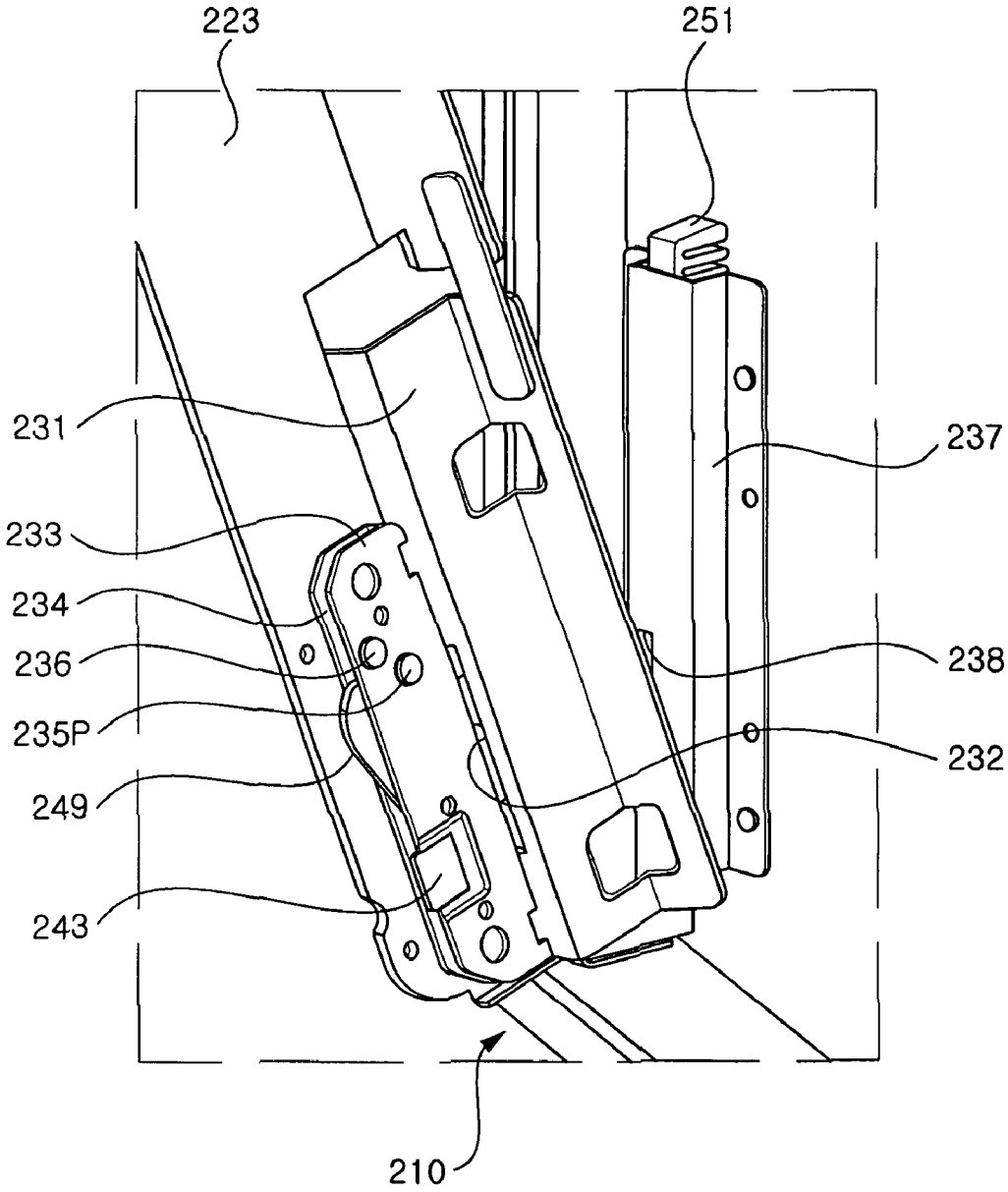
FIG. 8 is a perspective view showing the tilted door according to the second embodiment of the present invention.

FIG. 5 is a perspective view showing a side of an apparatus for tilting a door for a refrigerator according to the second embodiment of the present invention. FIG. 6 is a perspective view showing an essential part of the apparatus for titling the door for the refrigerator according to the second embodiment of the present invention. FIG. 7 is a side view showing a hinge assembly of the apparatus for tilting the door for the refrigerator according to the second embodiment of the present invention. FIG. 8 is a perspective view showing the tilted door according to the second embodiment of the present invention.

As shown in FIGS. 5 to 8, the storage chamber (not shown) defined in the body 200 of the refrigerator is selectively opened and closed by means of a door 210. The door 210 is provided at the back thereof with a basket frame 220. The basket frames 220 respectively include a basket installation member 221 to which a basket (not shown) is detachably installed, and a door connection member 223 connected to the rear surface of the door 210.

The basket installation member 221 has a square frame shape, which is horizontally provided. The basket installation member 221 is provided with a moving rail 221R on a side surface thereof. The door connection member 223 has a square frame shape, which is vertically provided. The door connection member 223 is connected at the lower end thereof to the rear surface of the door 210 by means of the tilting hinge assembly. A dissection 224 is formed at the lower end of the door connection member 223.

The dissection 224 has a tilting bracket 231 fixed thereto and longitudinally elongated. The first guide slot 232 is longitudinally formed in the tilting bracket 231. Further, a receptacle 233 is fixed adjacent to the dissection 224 to a side surface of the door connection member 223. The second guide slot 234 is formed in the receptacle 223.

As shown in FIG. 6 in detail, a receptacle 233 receives a roller 235 rotatably mounted on a roller pin 235P extending through the second guide slot 234 in the receptacle 233. The roller 235 guides the movement of a tilting hinge 249 described below during the tilting of the door 210 by a predetermined angle. Further, the roller 235 is received in the roller reception seat 249A of the tilting hinge 249 in the state in which the door 210 is tilted at the predetermined angle.

In the present embodiment, the receptacle 233 is provided with a stopper 236. The stopper 236 extends through the second guide slot 234. The stopper 236 prevents the door 210 from tilting any more after the door 210 is tilted to the predetermined angle. To this end, the stopper 236 is received in a stopper reception seat 249B of the tilting hinge 249 when the door 210 is tilted to the predetermined angle. In order to receive the stopper 236 in the stopper reception seat 249B before the roller 235 is received in the roller reception seat 249A of the tilting hinge 249, the stopper 236 is located at a position spaced apart from the roller 235 upward and backward.

As shown in FIGS. 7 and 8, meanwhile, a door bracket 237 is attached to a lower portion on the rear surface of the door 210. The door bracket 237 is formed with a through slot 238 corresponding to the first and second guide slots 232 and 234. A tilting hinge assembly is disposed between the rear surface of the door 210 and the inner surface of the door bracket 237 in order to connect the door 210 to the basket frame 220 so that the door 210 can be tilted at the predetermined angle.

A hinge supporter 241 constituting the tilting hinge assembly is elongated between the rear surface of the door 210 and the inner surface of the door bracket 237. The hinge supporter 241 has a door hinge 243, a support bar 245, and a tilting hinge 249, which are mounted thereto.

The door hinge 243 connects the door 210 to the door connection member 223 so that the door 210 rotates around the connection member 223. One end of the door hinge 243 is connected to the lower end of the hinge supporter 241 so as to rotate around the first hinge pin 243P. The other end of the door hinge 243 sequentially extends through the first and second guide slots 232 and 234 so that the door hinge 243 is supported to a side of the receptacle 233.

The support bar 245 is longitudinally elongated on an upper portion of the hinge supporter 241 corresponding to an upper portion of the first hinge pin 243P. The upper portion of the support bar 245 is connected to a fixing clip 246 fixed to a side of the hinge supporter 241 so as to be moved upward and downward with the tilting of the door 210. The lower end of the support bar 245 is rotatably connected to one end of the tilting hinge 249.

The support bar 245 is provided with a spring 247. The spring 247 provides elasticity to the tilting hinge 249 in a movement direction of the tilting hinge 249 while the tilted door 210 closes the storage chamber. The spring 247 is compressed such that both ends thereof are supported by a side of the fixing clip 246 and a support pin 245P provided on an outer peripheral surface of the support bar 245, respectively.

The tilting hinge 249 enables the door 210 to rotate around the door hinge 243 so as to tilt to the predetermined angle. As the door 210 is tilted, the tilting hinge 249 is guided by the roller 235 so as to move forward and backward along a predetermined trajectory in the state in which the outer peripheral surface of the roller 235 is in close contact with the upper surface of the tilting hinge 249. One end of the tilting hinge 249 is rotatably connected to the lower end of the support bar 245, as described above. The other end of the tilting hinge 249 extends through the through slot 238 and the first and second guide slots 232 and 234. A portion of the tilting hinge 249 near one end thereof is connected to the center portion of the hinge supporter 241 so as to rotate around the second hinge pin 249P.

On the other hand, the tilting hinge 249 is provided with a roller reception seat 249A and a stopper reception seat 249B on an upper surface of one end thereof. The roller reception seat 249A receives the roller 235 when the door 210 is tilted to the predetermined angle. The stopper reception seat 249B receives the stopper 236 so as to substantially maintain the tilting of the door 210 when the door 210 is tilted at the predetermined angle. As described above, the roller reception seat 249A and the stopper reception seat 249B are formed at the other end of the tilting hinge 249 by a desired distance, so that the stopper 236 is safely received in the stopper reception seat 249B before the roller 235 is received in the roller reception seat 249A, in the state in which the door 210 is tilted at the predetermined angle.

Reference numeral 251 as not mentioned above indicates an elastic member. The elastic member 251 is provided to the upper end of the door bracket 237 so as to play the role of controlling the tilting velocity of the door 210.

Hereinafter, the operation of the apparatus for tilting the door for the refrigerator according to the second embodiment of the present invention, constructed as described above, will be described in detail.

As shown in FIGS. 5 to 7, first, in the state in which the door 210 closes the storage chamber, that is, when the door 210 is not tilted, the door connection member 223 is in close contact with the rear surface of the door 210. The upper surface of the tilting hinge 249, which extends through the through slot 238 and the first and second guide slots 232 and 234 toward the rear surface of the door 210, is maintained to be in close contact with the outer peripheral surface of the roller 235 by the elasticity of the spring 247.

On the other hand, in the state in which the storage chamber is closed by the door 210, in order to tilt the door 210 by the predetermined angle, the upper end of the door 210 is pulled to be inclined downward. Thus, the door 210 rotates around the door hinge 243, substantially the first hinge pin 243P. Further, the tilting hinge 249 is guided by the roller 235 and moves along the desired trajectory.

When the door 210 is tilted by the predetermined angle, the stopper 236 is received in the stopper reception seat 249B before the roller 235 is received in the roller reception seat 249A. Thus, as the tilting hinge 249 cannot move forward any more, the door 210 also cannot be tilted. Accordingly, the door 210 maintains its tilted state at the predetermined angle. Meanwhile, the stopper 236 is received in the stopper reception seat 249B before the roller 235 is received in the roller reception seat 249A. Therefore, the roller 235 may be damaged by impact occurring when the roller 235 is received in the roller reception seat 249A. As the result, the door 210 becomes unsuitably tilted so as to incompletely close the storage chamber.

When the door 210 is tilted by the desired angle, the upper portion of the storage chamber is open so that foods can be put in or drawn out of the storage chamber. When the putting or drawing of foods in/from the storage chamber is completed, the upper end of the door 210 is pushed upward, so as to close the storage chamber.

Hereinafter, an apparatus for tilting a drawer type door for a refrigerator according to the third embodiment of the present invention will be described in detail with reference to the accompanying drawings.

Figure 9:
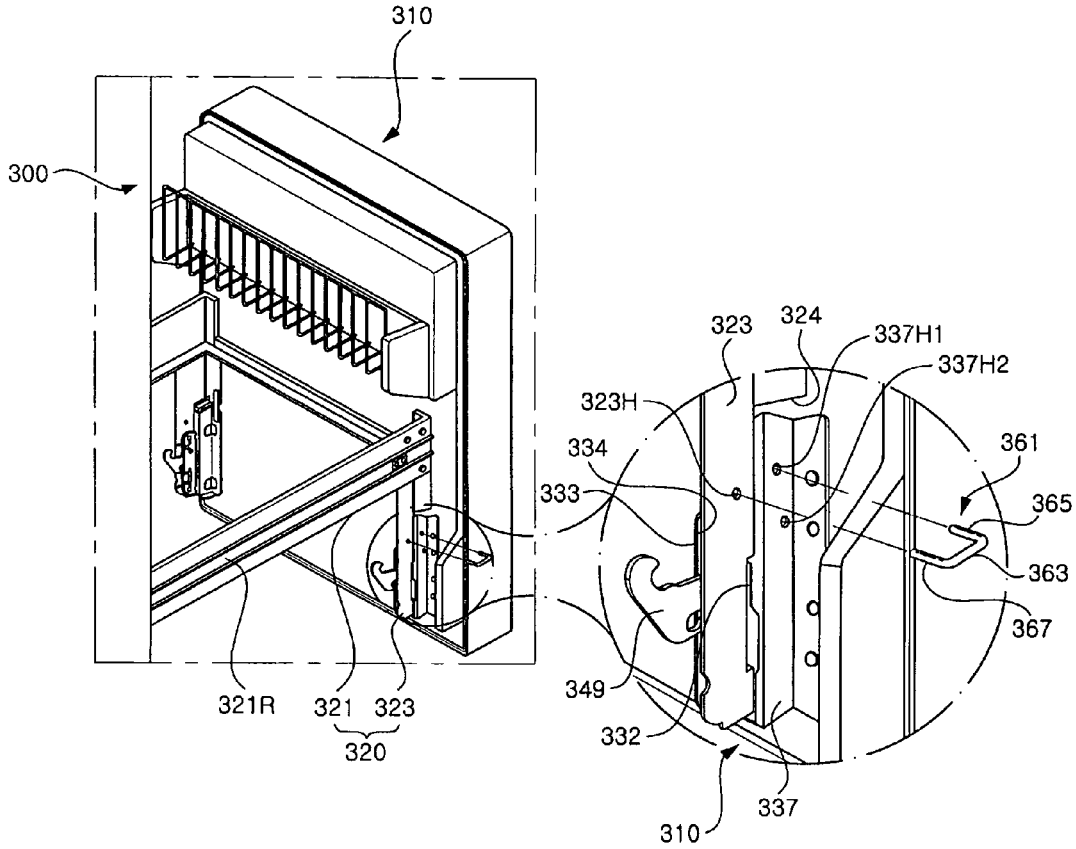
FIG. 9 is an exploded perspective view showing a side of an apparatus for tilting a door for a refrigerator according to the third embodiment of the present invention.

FIG. 9 is an exploded perspective view showing a side of an apparatus for tilting a door for a refrigerator according to the third embodiment of the present invention.

As shown in FIG. 9, the refrigerator has a body 300 with a storage chamber (not shown) selectively closed and opened by means of a door 310. The door 310 is provided on the rear surface thereof with basket installation members 321 to which a basket (not shown) is detachably attached, and basket frames 320 respectively including a door connection member 323 connected to the rear surface of the door 310.

The basket installation member 321, which has a square frame shape and is horizontally provided, has a moving rail 321R fixed to a side surface thereof. The upper end of the door connection member 323 having a square frame shape and vertically provided is fixed to a leading end of the basket installation member 321. Each door connection member 323 is connected at the lower end thereof to the rear surface of the door 310 by means of a tilting hinge assembly. The door connection member 323 has a dissection 324 formed at the lower end thereof.

In the present embodiment, a locking hole 323H is formed in a side of the door connection member 323 near the dissection 324. In order to restrict the tilting of the door 310, a first insertion portion 363 (or a second insertion portion 365) of a tilting prevention member 361 described below is inserted into the locking hole 323H.

A longitudinally elongated receptacle is fixed to a side surface of the door connection member 323. A guide slot 334 is longitudinally formed in the receptacle 333. As shown in FIG. 6 in detail, a roller pin 335P extends through the guide slot 334. A roller (not shown) is rotatably mounted on the roller pin 335P.

On the other hand, the door 310 is provided at the lower end thereof with a door bracket 337. The door bracket 337 is formed with a through slot 338 corresponding to the guide slot 334. Further, first and second insertion holes 337H1 and 337H2 are formed in the door bracket 337. The first and second insertion portion 363 and 365 of the tilting prevention member 361 are respectively inserted into the first and second insertion holes 337H1 and 337H2 in order to restrict or allow the tilting of the door 310. In the present embodiment, the first insertion hole 337H1 is formed above the second insertion hole 337H2. Further, the first insertion hole 337H1 is located at a position spaced at an equidistance from the locking hole 323H and the second insertion hole 337H2.

A tilting hinge assembly is disposed between the rear surface of the door 310 and the inner surface of the door bracket 337 in order to connect the door 310 to the basket frame 320 so as to tilt the door 310 by the predetermined angle. The tilting hinge assembly of the present embodiment has the same configuration as those of the first and second embodiments. Thus, the description of the tilting hinge assembly will be omitted.

The tilting prevention member 361 is provided in order to restrict or allow the tilting of the door 310. A wire having a desired length is bent in a C shape so as to form the tilting prevention member 361. Specifically, the tilting prevention member 361 includes a grip portion 363 with a desired length, and the first and second insertion portions 365 and 367 extending normal to both ends of the grip portion 363.

The grip portion 363 is a portion with which a user grasps the tilting prevention member 361 in order to restrict or allow the tilting of the door 310 using the tilting prevention member 361. The grip portion 363 has a length equal to the distance between the first insertion hole 337H1 and the locking hole 323H and also the locking hole 323H and the second insertion hole 337H2.

In the case of restricting the tilting of the door 310, the first and second insertion portions 363 and 365 are respectively inserted into the locking hole 323H and the first insertion hole 337H1. In the case of allowing the tilting of the door 310, the first and second insertion portions 363 and 365 are respectively inserted into the first and second insertion holes 337H1 and 337H2.

Reference numeral 351, which is not described above, indicates an elastic member. The elastic member 351 is disposed to the upper end of the door bracket 337, and plays the role of controlling the tilting velocity of the door.

Hereinafter, the operation of the apparatus for tilting the door for the refrigerator, which restricts or allows the tilting of the door, according to the third embodiment of the present invention will be described in detail.

Figure 10:
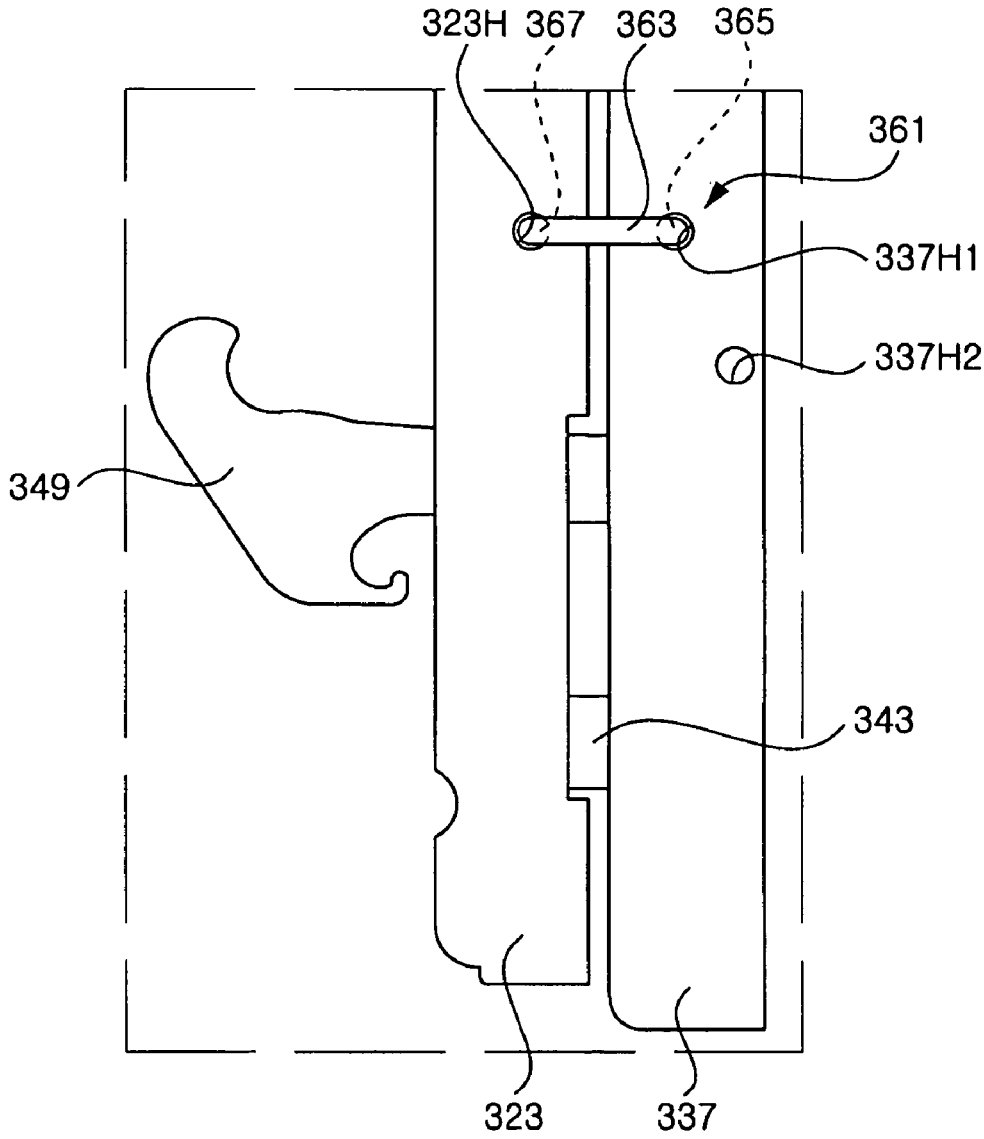
FIG. 10 is a side view showing the apparatus for tilting the door for the refrigerator according to the third embodiment of the present invention, in which the tilting of the door is restricted.
Figure 11:
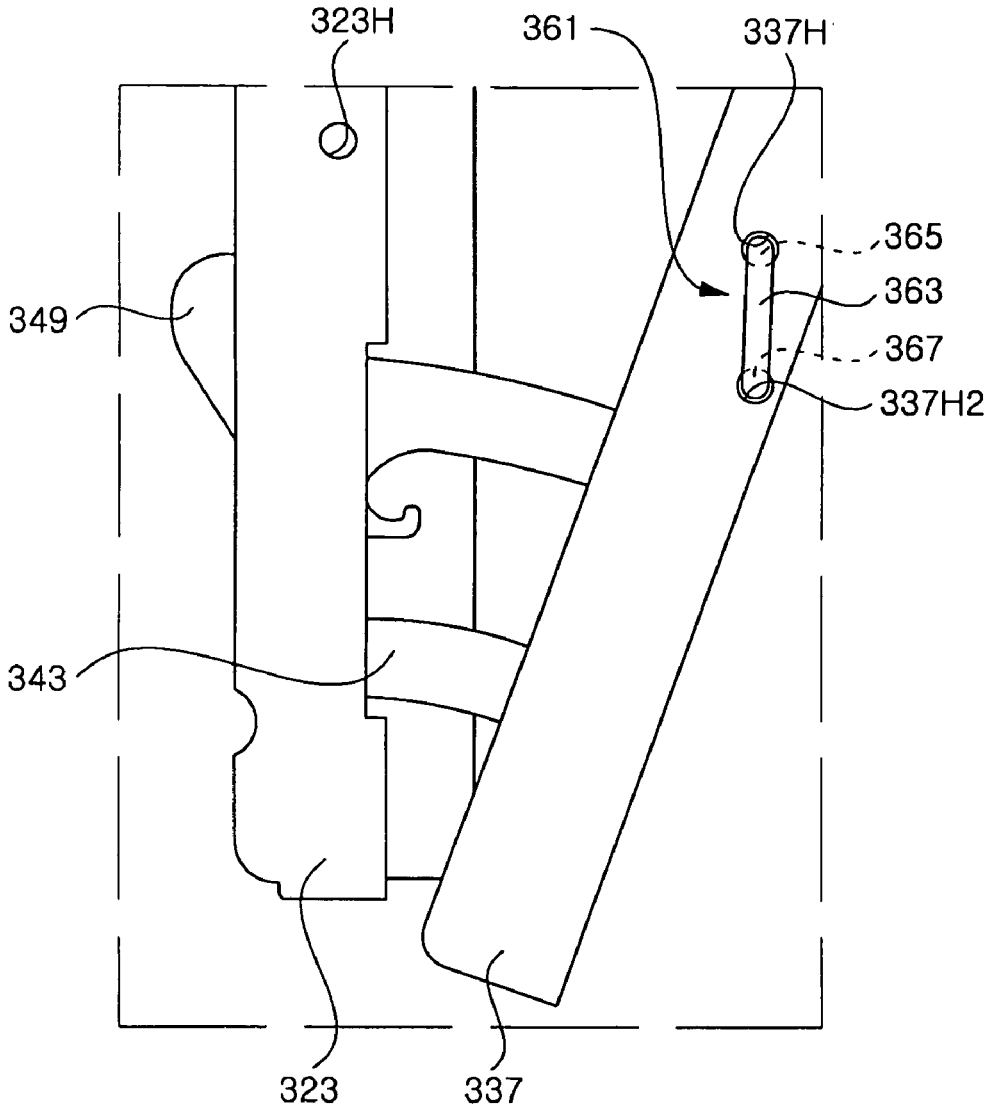
FIG. 11 is a side view showing the apparatus for tilting the door for the refrigerator according to the third embodiment of the present invention, in which the tilting of the door is allowed.

FIG. 10 is a side view showing the apparatus for tilting the door for the refrigerator according to the third embodiment of the present invention, in which the tilting of the door is restricted. FIG. 11 is a side view showing the apparatus for tilting the door for the refrigerator according to the third embodiment of the present invention, in which the tilting of the door is allowed.

First, in order to restrict the tilting of the door 310, a user grasps the grip portion 363 with a hand, and inserts the first and second insertion portions 363 and 365 into the first insertion hole 337H1 and the locking hole 323H, respectively. Of course, the first and second insertion portions 363 and 365 may be inserted into the locking hole 323H and the first insertion hole 337H1, respectively.

As shown in FIG. 10, therefore, the tilting of the door 310 is restricted by means of the tilting prevention member 361. In the state that the tilting of the door 310 is restricted as described above, although the user pulls the door 310 forward, the door 310 is not tilted while the storage chamber is opened.

On the other hand, in order to tilt the door 310 by the predetermined angle, the user grasps the grip portion 363 with his/her hand, and removes the first and second insertion portions 363 and 365 from the first insertion hole 337H1 and the locking hole 323H. Then, the first and second insertion portions 363 and 365 are inserted into the first and second insertion portions 337H and 337H2 so that the tilting prevention member 361 is located and held at a desired portion.

Accordingly, the tilting of the door 310 is allowed as shown in FIG. 11. In the state of allowing the tilting of the door 310 as described above, the user pulls the upper end of the door 310 downward, so as to tilt the door 310 by the predetermined angle. Then, after the door 310 is tilted, the user can put or draw the foods in/out of the basket.

In the third embodiment of the present invention, the first and second insertion holes 337H1 and 337H2 are formed in the door bracket 337, but this is not limited to the third embodiment. For example, the first and second insertion holes 337H1 and 337H2 may be formed in the tilting hinge assembly, i.e. the support bar, etc., which constitute the tilting hinge assembly.

Hereinafter, an apparatus for tilting a door for a refrigerator according to the fourth embodiment of the present invention will be described in detail with reference to the accompanying drawings.

Figure 12:
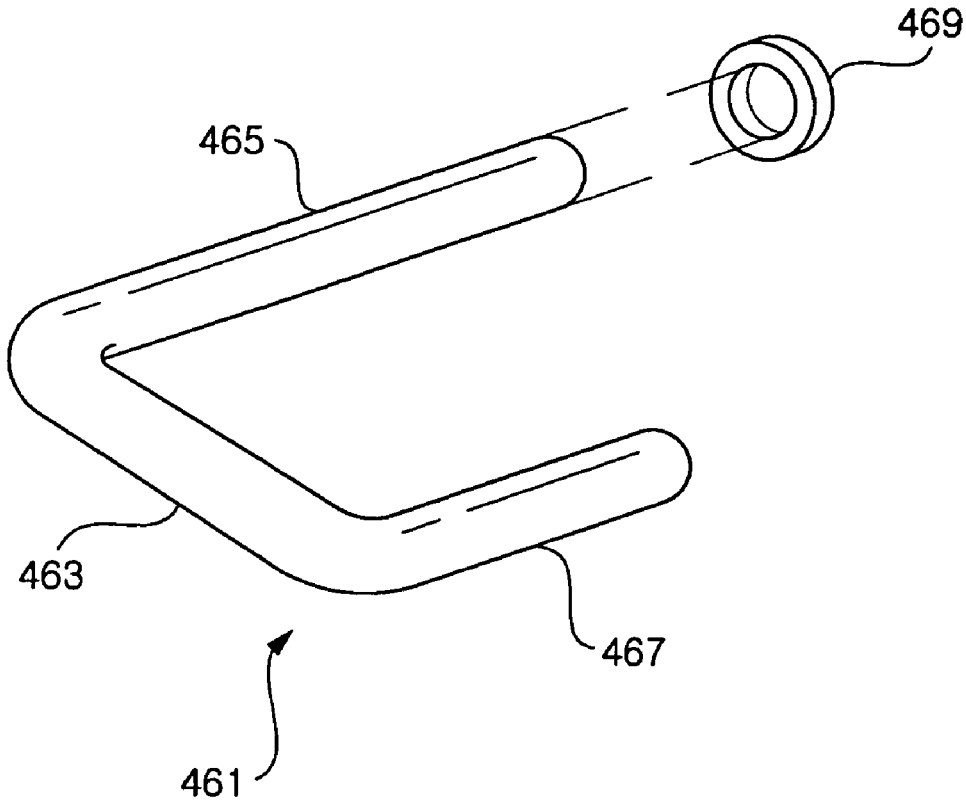
FIG. 12 is a perspective view showing a tilt prevention member constructing an apparatus for tilting a door for a refrigerator according to the fourth embodiment of the present invention.

FIG. 12 is a perspective view showing a tilt prevention member constructing an apparatus for tilting a door for a refrigerator according to the fourth embodiment of the present invention. The present embodiment has the same configuration as that of the third embodiment of the present invention, excluding the tilting prevention member. Therefore, the present embodiment will be described using the reference numerals of FIGS. 9 to 11.

As shown in FIG. 12, the tilting prevention member 461 has a grip portion 463 with a desired length, and first and second insertion portions 465 extending normally to both ends of the grip portion 463 in the same direction. In this embodiment, the first insertion portion 463 and the second insertion portion 465 have different lengths from each other. Specifically, the first insertion portion 463 is relatively longer than the second insertion portion 465.

A removal prevention ring 469 is mounted on a terminal end of the first insertion portion 463. When the first insertion portion 464 is inserted in the first insertion hole 346H1, the removal prevention ring 469 may allow the first insertion portion 463 to move in the first insertion hole 346H1 in an insertion direction, i.e. horizontal direction, but prevent the first insertion portion 463 from voluntarily unlinking from the first insertion hole 346H1.

Therefore, in the state that the first insertion portion 463 is inserted into the first insertion hole 346H1, the tilting prevention member 461 is rotated around the first insertion portion 463, and then the second insertion portion 465 is selectively inserted into the locking hole 323H or the second insertion hole 346H2 so as to restrict or allow the tilting of the door 310. For example, in the state in which the tilting of the door 310 is restricted, i.e. the state in which the first and second insertion portions 463 and 465 are inserted into the first insertion hole 346H1 and the locking hole 323H, the tilting prevention member 461 is pulled, so that the second insertion portion 465 is removed from the locking hole 323H. However, although the second insertion portion 465 is removed from the locking hole 323H, the first insertion portion 463 is not removed from the first insertion hole 346H1 because the first insertion portion 463 is relatively longer than the second insertion portion 465 and has the removal prevention ring 469 mounted on the terminal end thereof. In this state, the tilting prevention ring 469 is rotated around the first insertion portion 463 inserted in the first insertion hole 346H so that the second insertion portion 465 is located to correspond to the second insertion hole 346H2. Then, the tilting prevention member 461 is pushed so that the second insertion portion 465 is inserted into the second insertion hole 346H2, and thereby it is possible to fix and maintain the tilting prevention member 461 at a desired position in the state in which the tilting of the door 310 is allowed.

Hereinafter, an apparatus for tilting a drawer type door for a refrigerator according to the fifth embodiment of the present invention will be described in detail with reference to the accompanying drawings.

Figure 13:
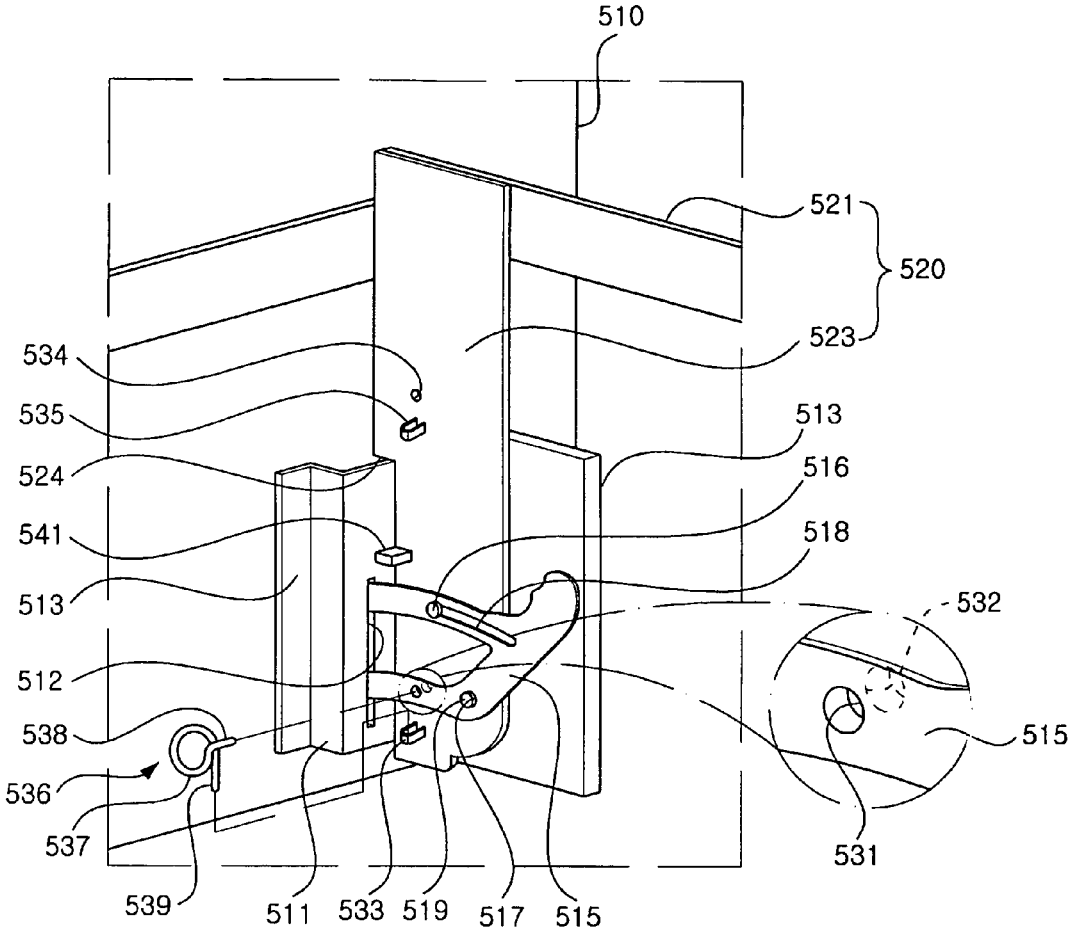
FIG. 13 is an exploded perspective view showing an apparatus for tilting a door for a refrigerator according to the fifth embodiment of the present invention.

FIG. 13 is an exploded perspective view showing an apparatus for tilting a door for a refrigerator according to the fifth embodiment of the present invention.

As shown in FIG. 13, the door 510 selectively opens and closes a storage chamber (not shown). The door 510 opens and closes the storage in an operation manner of a drawer. Further, the door 510 is tilted by a predetermined angle in such a manner that the upper end thereof rotates around the lower end thereof forward from the storage chamber by means of the tilting hinge 515 described below.

The door 510 is provided with a door bracket 511 on the lower portion of the rear surface thereof. The door bracket 511 generally has a C-shaped cross section, which is longitudinally elongated. The door bracket 511 has a through slot 512 longitudinally formed in a surface thereof parallel with the rear surface of the door 510.

In addition, the door 510 is provided with shield brackets 513 attached to both sides of the rear surface of the door 510 corresponding to a side of the door bracket 511, respectively. The shield bracket 513 extends backward from both sides of the door 510 by a desired distance and shields a tilting hinge 515.

The tilting hinge 515 is installed between the rear surface of the door 510 and the door bracket 511. The tilting hinge 515 connects the door 510 to a basket frame 520 described below so that the door 510 can be tilted. The tilting hinge 515 has a fan shape with a desired angle. The tilting hinge 515 has one end fixed to the rear surface of the door 510, and the other end extending through a through slot 512 toward the rear surface of the door 510. In the present embodiment, the door 510 is installed and tilted to the desired angle by means of the tilting hinge. Further, the door 510 may be connected to the basket frame 520 by means of a tilting assembly including a hinge supporter, a door hinge, a tilting hinge, and a support member, etc., so as to be tilted in such a manner described in the first to fourth embodiments.

The tilting hinge 515 has a slot 516 formed at the upper portion thereof and having a fan shape with a desired angle. The tilting hinge has a hinge hole 517 formed at the lower portion thereof. The tilting hinge 515 is connected to the basket frame 520 by means of an upper hinge pin 518 extending through the slot 516 and a lower hinge pin 519 extending through the hinge hole 517. When the door 510 is tilted by the predetermined angle, the upper hinge pin 518 slides along the slot 516, and the lower hinge pin 519 rotates in the hinge hole 517 in the state of extending through the hinge hole 517.

On the other hand, the door 510 is provided with the basket frame 520 on the rear surface thereof. The basket frame 520 includes a basket reception member 521 detachably installed to the basket and a door connection member 523 connected to the door 510 by means of the tilting hinge 515.

The door connection member 523 is formed in a square frame shape, which is vertically provided. The door connection member 523 has a dissection 524 formed at the lower portion thereof to correspond to the door bracket 511. One end of the upper hinge pin 518 extending through the slot 516 and one end of the lower hinge pin 519 are respectively fixed to a side of the door connection member 523 near the dissection 524.

On the other hand, a locking hole 531 is formed in a side of the tilting hinge 515 extending backward through the through slot 512, through which the first end of the tilting prevention pin 536 described below extends so as to restrict the tilting of the door 510.

In the state that the door 510 is not tilted so as to shield the storage chamber, an insertion hole 532 is formed at a side of the door connection member to correspond to the locking hole 531. Hereinafter, the insertion hole is referred to as a first insertion hole 532 for the purpose of description. The first insertion hole 532 receives the first end 538 of the tilting prevention pin 536 which extends through the locking hole 531 and is inserted through the first insertion hole 532, in order to restrict the tilting of the door 710.

Further, in the state that the door 510 is not tilted, the door connection member 523, which does not overlap with the tilting hinge 515, is provided with a support member 533 on a side thereof. Hereinafter, the support member is referred to as a first support member 533 for the purpose of description. When the first end 538 of the tilting prevention pin 536 extends through the locking hole 531 and is inserted in the first insertion hole 532 in order to restrict the tilting of the door 510, the first support 533 supports the second end 539 of the tilting prevention pin 536.

On the other hand, the door connection member 523 further has an insertion hole 534 and a support member 535 formed at a side thereof spaced from the movement trajectory of the tilting hinge 515 while the door 510 is tilted by the desired angle. The insertion hole 534 and the support member 535 hold the tilting prevention pin 536 in the state of allowing the tilting of the door 510. Hereinafter, the insertion hole 534 and the support member 535 are referred to as a second insertion hole 534 and a second support member 535, respectively. The first end 538 of the tilting prevention pin 536 is inserted into the second insertion hole 534, and the second end 539 thereof is supported by the second support member 535.

The tilting prevention pin 536 restricting and allowing the tilting of the door 510 includes a grip portion 537 that a user grasps with his/her hand, the first end 538 inserted into the locking hole 531 and the first insertion hole 532, or the second insertion hole 534, and the second end 539 supported by the first support member 533 or the second support member 535. The tilting prevention pin 536 is preferably formed such that the first and second ends 538 and 539 provide desired elasticity to each other. This is to prevent the tilting hinge 515, the door connection member 523, or the tilting prevention pin 536 from being damaged due to the elastic deformation of the tilting prevention pin 536 caused by external force occurring when the user forcibly tilts the door in the state in which the tilting of the door 510 is restricted.

The grip portion 537 is made by bending a rod such as wire so as to have a ring shape with a desired diameter. The first end 538 is formed such that one end of the rod forming the grip portion 537 extends normally to a plane surface formed by the grip portion 537. Further the second end 539 is formed by extending the other end of the rod forming the grip portion 537 in a tangent direction of the grip portion 537.

The door bracket 511 is provided with a buffer member 541 on a side thereof. The buffer member 541 is provided on a side of the door bracket 511 with which the other end of the tilting hinge 515 contacts, in the state that the door 510 is tilted. The buffer member 541 absorbs impact occurring between the door 510 and the tilting hinge 515 while the door 510 is tilted. To this end, the buffer member 541 is preferably made from a flexible material with a desired elasticity.

Hereinafter, the operation of the apparatus for tilting the door for the refrigerator according to the fifth embodiment of the present invention, which restricts and allows the tilting of the door, will be described in detail with respect to the accompanying drawings.

Figure 14A:
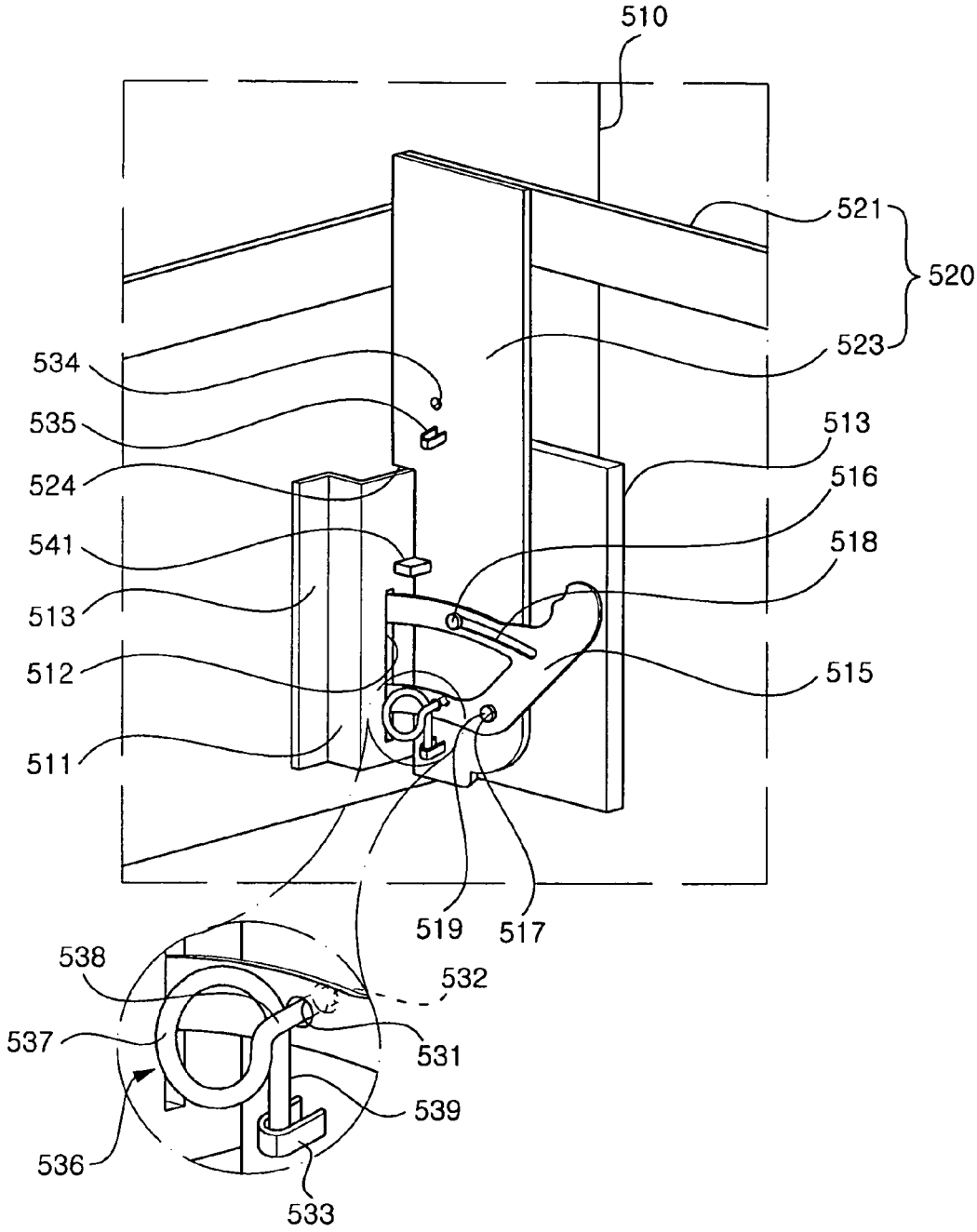
FIG. 14A is a perspective view showing the apparatus for tilting the door for the refrigerator according to the fifth embodiment of the present invention, in which the tilting of the door is restricted.
Figure 14B:
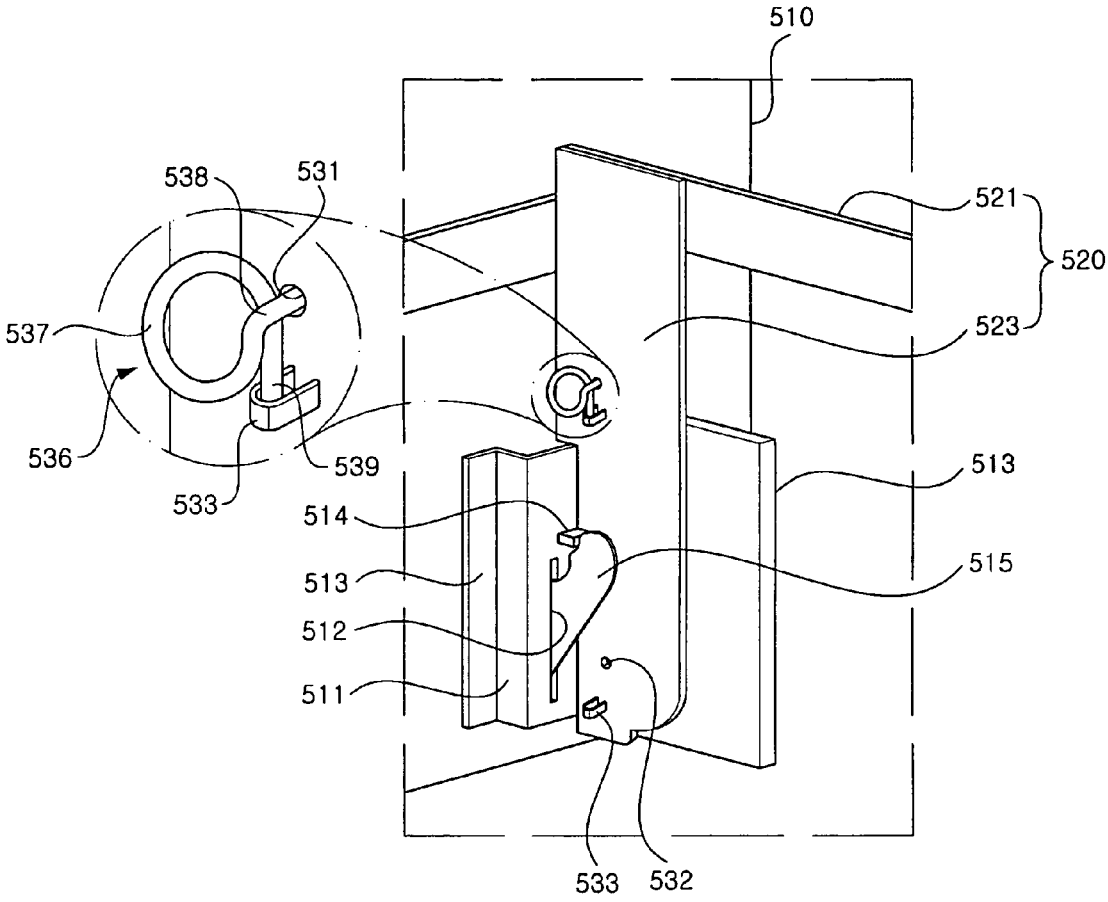
FIG. 14B is a perspective view showing the apparatus for tilting the door for the refrigerator according to the fifth embodiment of the present invention, in which the tilting of the door is allowed.
Figure 15:
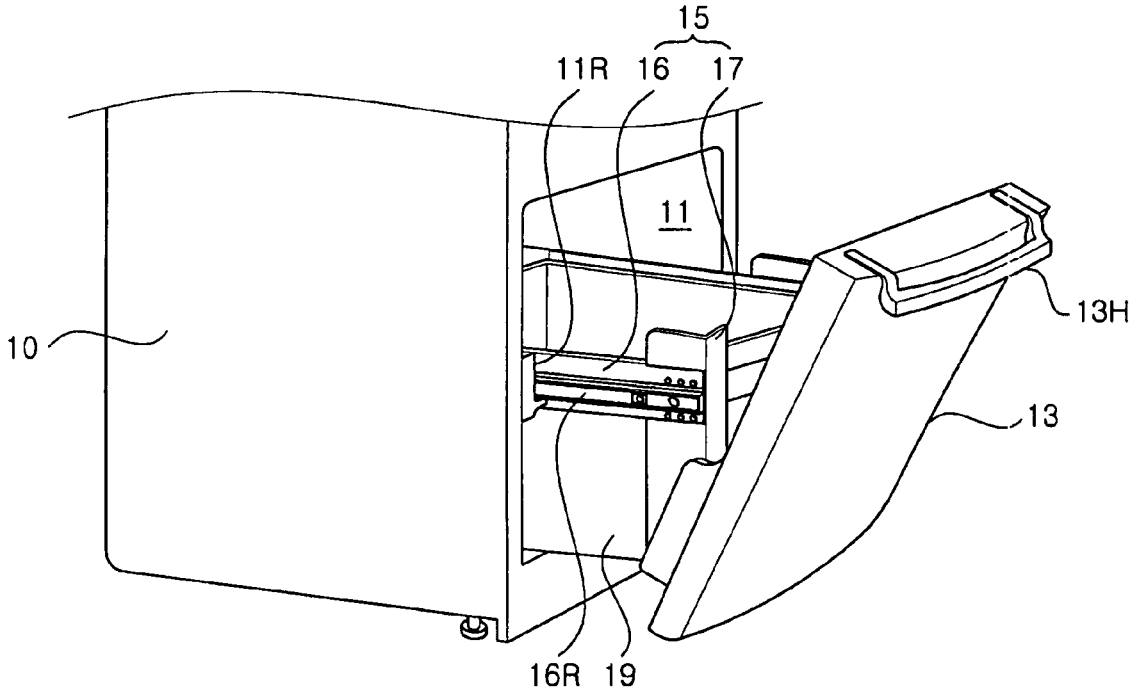
FIG. 15 Related Art
FIG. 15 is a perspective view showing a conventional refrigerator.

FIG. 14A is a perspective view showing the apparatus for tilting the door for the refrigerator according to the fifth embodiment of the present invention, in which the tilting of the door is restricted. FIG. 14B is a perspective view showing the apparatus for tilting the door for the refrigerator according to the fifth embodiment of the present invention, in which the tilting of the door is allowed.

As shown in FIG. 14A, first, in the case of restricting the tilting of the door 510, the first end 538 of the tilting prevention pin 536 is inserted into the locking hole 531 and the first insertion hole 532. The second end 539 of the tilting prevention pin 536 is supported by the first support member 533. Thus, the door 510 cannot rotate with the basket frame 520, particularly the door connection member 523. In other words, the tilting of the door is restricted.

When the tilting of the door is restricted as described, the door 510 cannot be tilted with the basket frame 520 even if the user pulls the door 510 forward from the storage chamber. Specifically, the user pulls the door 510 forward from the storage chamber so as to open the storage chamber in the state in which the door 510 is not tilted.

Further, in the state of restricting the tilting of the door 50, the user pulls the upper end of the door 510 downward in order to tilt the door 510. Thus, external force is applied to the first end 538 of the tilting prevention pin 536, the locking hole 531 of the tilting hinge 515, and the first insertion hole 532 of the door connection member 523. However, since the tilting prevention pin 536 has a desired elasticity, the tilting prevention pin 536 is elastically deformed by the external force. Thus, in the state that the tilting of the door 510 is prevented, it is possible to prevent the damage of the tilting prevention pin 536, etc. even if external force is applied to the tilting prevention pin 536 in order to tilt the door 510. In order to allow the tilting of the door 510, the first end 538 is removed from the locking hole 531 and the first insertion hole 532. Further, the second end 539 is removed from the first support member 533. Thus, the tilting of the door can be allowed. Therefore, the user pulls the door 510 forward from the storage chamber and tilts the door 510, so as to put and draw foods in/out of the basket 19 in the state in which a portion of the storage chamber is opened.

If necessary, the user can continuously pull the door forward from the storage chamber so as to open and close a portion or all of the storage chamber, in the state in which the door 510 is tilted. When a portion or all of the storage chamber opens, it is possible to put or draw foods in/out of the basket 19.

On the other hand, when the tilting of the door is allowed, the tilting prevention pin 536 can be held at a side of the door connection member 523. As shown in FIG. 14B, the first end 538 is inserted into the second insertion hole 534, and the second end 539 is supported by the second support member 535. As described above, the tilting prevention pin 536 is held at a side of the door connection member 523, thereby preventing loss of the tilting prevention pin 536.

The apparatus for tilting the door for the refrigerator according to the present invention constructed as described above has advantages as follow:

First, during the tilting of the door according to the present invention, the movement of the tilting hinge is guided by the roller. When the door is tilted at a desired angle, the roller is received in the roller reception portion of the tilting hinge. Thus, it is possible to reduce the damage in the product due to external force occurring when the door is tilted and to improve the durability of the product.

Further, the present invention provides the stopper and the stopper reception portion receiving the stopper, so as to minimize the damage in the roller while the roller is received in the roller reception portion. Thus, it is possible to prevent damage to the product due to external force applied to the product during the tilting of the door.

In addition, according to the present invention the tilting prevention member can restrict and allow the tilting of the door. Thus, the user can restrict and allow the tilting of the door depending on his/her necessity, thereby using the refrigerator with convenience.

Further, according to the present invention, in the case of allowing the tilting of the door, the tilting prevention pin, which is used to restrict and allow the tilting of the door, can be held at a side of the refrigerator. Thus, it is possible to prevent the loss of the tilting prevention pin, and to use the product more efficiently.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A tilting apparatus that tilts a door configured to open and close a storage chamber of a refrigerator, the apparatus comprising:

first and second receptacles respectively provided at first and second lateral side ends of a basket frame configured to be positioned at a rear surface of the door and to removably receive a storage basket therein;

first and second rollers rotatably installed in the first and second receptacles, respectively;

first and second door hinges each having a first end thereof rotatably coupled to the rear surface of the door and a second end thereof fixed to a side of a respective receptacle;

first and second tilting hinges each having a first end thereof rotatably coupled to the rear surface of the door and a second end thereof provided with a roller reception portion configured to receive a respective roller therein based on a position of the door, wherein the first and second tilting hinges maintain rolling contact with the first and second rollers, respectively, so as to move along a predetermined trajectory as the door rotates about the first and second door hinges, and wherein the first and second rollers are received in a respective roller reception portion so as to limit a tiling angle of the door;

first and second door brackets each fixed to the rear surface of the door, at positions corresponding to the first and second receptacles, respectively, and first and second hinge supporters respectively installed within the first and second door brackets, wherein the first and second hinge supporters each comprises:

a first hinge pin to which the first end of the respective door hinge is rotatably coupled;

a second hinge pin to which the first end of the respective tilting hinge is rotatably coupled;

a support bar that extends between the first end of the respective tilting hinge and an upper end portion of the respective hinge supporter; and a spring positioned on the support bar so as to elastically support the respective tilting hinge; and first and second tilting brackets respectively coupled to the first and second receptacles, each of the first and second tilting brackets having a first guide slot formed therein that is aligned with a second guide slot formed in the respective receptacle and a through hole formed in the respective door bracket, wherein the first and second door hinges and the first and second tilting hinges extend from the respective hinge supporter, through the guide slot formed in the respective door bracket, through the first guide slot formed in the respective tilting bracket, and into the respective receptacle through the second slot formed therein.

2. A tilting apparatus that tilts a door configured to open and close a storage chamber of a refrigerator, the apparatus comprising:

first and second door connection members respectively provided at first and second lateral side ends of a basket frame configured to be positioned at a rear surface of the door and to removably receive a storage basket therein, each of the first and second door connection members comprising:

a receptacle, comprising:

first and second lateral members having a space formed therebetween that defines a receptacle guide slot;

a pin that extends horizontally through the first and second lateral members and the receptacle guide slot; and a roller rotatably installed on the pin, in the receptacle guide slot; and a tilting bracket coupled to the receptacle, the tilting bracket having a tilting bracket guide slot formed therein that is aligned with the receptacle guide slot formed in the receptacle;

first and second door brackets coupled to a rear surface of the door, at positions corresponding to the first and second door connection members, respectively;

first and second hinge supporters coupled to the rear surface of the door and respectively installed within spaces formed between the rear surface of the door and the first and second door brackets;

first and second door hinges each having a first end thereof rotatably coupled a respective hinge supporter and a second end thereof fixed to a side of a respective receptacle; and first and second tilting hinges each having a first end thereof rotatably coupled a respective hinge supporter and a second end thereof in rolling contact with a respective roller.

3. The apparatus of claim 2, wherein the first and second door hinges and the first and second tilting hinges extend from the respective hinge supporter, through the tilting bracket guide slot formed in a respective tilting bracket, and into the respective receptacle through the receptacle guide slot formed therein.

4. The apparatus of claim 2, wherein the first and second hinge supporters each further comprise:

a first hinge pin to which the first end of the respective door hinge is rotatably coupled;

a second hinge pin to which the first end of the respective tilting hinge is rotatably coupled;

a support bar that extends between the first end of the respective tilting hinge and an upper end portion of the respective hinge supporter; and a spring positioned on the support bar so as to elastically support the respective tilting hinge.

5. The apparatus of claim 2, wherein the second ends of the first and second tilting hinges are each provided with a roller reception portion, and wherein the first and second tilting hinges move along a predetermined trajectory as the door rotates about the first and second door hinges and the first and second rollers roll along corresponding surfaces of the first and second tilting hinges, respectively, and wherein the first and second rollers are received in a respective roller reception portion so as to limit a tiling angle of the door.

* * * * *